US008249474B2

(12) United States Patent
Wada

(10) Patent No.: US 8,249,474 B2
(45) Date of Patent: Aug. 21, 2012

(54) IMAGE FORMING APPARATUS WHICH CONTROLS IMAGE FORMING CONDITIONS BASED ON RESIDUAL TONER OF A DETECTION PATTERN

(75) Inventor: Yuji Wada, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 132 days.

(21) Appl. No.: 12/835,193

(22) Filed: Jul. 13, 2010

(65) Prior Publication Data

US 2011/0013920 A1 Jan. 20, 2011

(30) Foreign Application Priority Data

Jul. 15, 2009 (JP) ..... 2009-166661

(51) Int. Cl.
*G03G 15/00* (2006.01)

(52) U.S. Cl. ..... 399/49

(58) Field of Classification Search ..... 399/49, 399/61, 62, 64, 29, 30, 66
See application file for complete search history.

(56) References Cited

U.S. PATENT DOCUMENTS 5,627,649 A * 5/1997 Sawayama et al. ..... 358/296

FOREIGN PATENT DOCUMENTS

| | | | |
|---|---|---|---|
| JP | 07306615 A | * | 11/1995 |
| JP | 2000-284554 | | 10/2000 |
| JP | 3264695 | | 12/2001 |
| JP | 2002-72702 | | 3/2002 |
| JP | 2002-323801 | | 11/2002 |
| JP | 2008-107398 | | 5/2008 |
| JP | 4340481 | | 7/2009 |

* cited by examiner

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

An image forming apparatus including a latent image carrier; a developing device to develop a latent image formed on a surface of the latent image carrier with toner to form a toner image; a transfer device to either directly transfer the toner image onto a recording medium, or to primarily transfer the toner image from the latent image carrier onto an intermediate transfer body and then secondarily transfer the toner image from the intermediate transfer body onto a recording medium; a post-transfer imaging unit to photograph the surface of the latent image carrier or the intermediate transfer body after transfer of the toner image; and a control unit to control one or more image forming conditions based on a quantified value for residual toner of a detection pattern formed on the surface of the latent image carrier or the intermediate transfer body.

25 Claims, 20 Drawing Sheets

IMAGE FORMING APPARATUS WHICH CONTROLS IMAGE FORMING CONDITIONS BASED ON RESIDUAL TONER OF A DETECTION PATTERN

CROSS-REFERENCE TO RELATED APPLICATIONS

The present patent application is based on and claims priority pursuant to 35 U.S.C. §119 from Japanese Patent Application No. 2009-166661, filed on Jul. 15, 2009 in the Japan Patent Office, which is incorporated herein by reference in its entirety.

BACKGROUND OF THE INVENTION

1. Field of the Invention

Exemplary aspects of the present invention generally relate to an image forming apparatus such as a copier, facsimile machine, and printer.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus. In the transfer device, alternatively, the toner image formed on the photoconductor may be primarily transferred onto an intermediate transfer body and then secondarily transferred onto a sheet from the intermediate transfer body.

One longstanding problem of such image forming apparatuses is the unwanted formation of irregular images that have uneven toner density or white spots caused by an uneven image transfer rate due to installation environment or state of use of the apparatus.

To prevent the formation of such irregular images, a method for determining appropriate image forming conditions (that is, determining an appropriate transfer rate) involving detecting the presence of residual toner on the photoconductor using a reflective optical sensor is widely known. In this method, a test pattern is formed on the photoconductor, and residual toner on the photoconductor after the test pattern is transferred onto a sheet or an intermediate transfer body is then detected by the reflective optical sensor to determine the appropriate image forming conditions.

In another approach, a test pattern is formed on an intermediate transfer belt, and then residual toner on the intermediate transfer belt after the test pattern is transferred onto a sheet is detected by a reflective optical sensor to determine the appropriate image forming conditions based on the results detected by the reflective optical sensor.

A problem with the use of reflective optical sensors, however, is that these sensors cannot detect small amounts of residual toner. The reflective optical sensor directs light onto a surface to be detected to detect an amount of residual toner based on an amount of light reflected from the surface to be detected. Specifically, when residual toner is present in a detection range where the light is directed (hereinafter referred to as a target detection range), the reflected light is diffused, an amount of reflective light entering a light receiving element of the reflective optical sensor is reduced, and the output from the reflective optical sensor is reduced compared to a case in which the residual toner is not present in the target detection range. However, when only a slight amount of residual toner is present in the target detection range, an amount of reflective light entering the light receiving element of the reflective optical sensor is not much different from that when the residual toner is not present in the target detection range. As a result, the output from the reflective optical sensor when only a slight amount of residual toner is present in the target detection range is almost the same as that when the residual toner is not present in the target detection range. Consequently, the reflective optical sensor may inadvertently detect that residual toner is not present even when a slight amount of residual toner is in fact present.

In a case in which a test pattern includes a solid patch having a length of several millimeters in a width direction thereof (that is, in a main scanning direction), a certain amount of toner of the solid patch remains as residual toner in the target detection range. Accordingly, the output from the reflective optical sensor is reduced to a certain degree compared to the case in which the residual toner is not present at all in the target detection range, thereby providing more accurate detection of the residual toner.

However, in a case in which the test pattern is formed as a line image having a length of several dots in a width direction thereof, only a slight amount of residual toner is present in the target detection range. Consequently, the output from the reflective optical sensor when only a slight amount of residual toner is present in the target detection range is almost the same as that when the residual toner is not present at all in the target detection range, preventing accurate detection of the residual toner as described above.

Line images are easily affected by uneven image transfer, such that even a slight increase in an amount of residual toner caused by variation in transfer rate can cause irregular images including white spots. Increasing demand for higher-quality images requires image forming apparatuses in which image forming conditions are controllable to prevent the formation of white spots in line images.

However, as described above related-art image forming apparatuses cannot accurately detect residual toner of the line images, thus preventing accurate detection of transfer rates of the line images. Consequently, image forming conditions are not controllable in the related-art image forming apparatuses, causing white spots in the line images.

SUMMARY

In view of the foregoing, illustrative embodiments of the present invention provide an image forming apparatus that can control image forming conditions by accurately detecting a transfer rate of line images to prevent white spots in the line images.

In one illustrative embodiment, an image forming apparatus includes a latent image carrier; a developing device to supply toner to the latent image carrier and develop a latent image formed on a surface of the latent image carrier with the toner to form a toner image; a transfer device to either directly transfer the toner image formed on the surface of the latent image carrier onto a recording medium, or to primarily transfer the toner image from the latent image carrier onto an intermediate transfer body and then secondarily transfer the toner image from the intermediate transfer body onto a recording medium; a post-transfer imaging unit to photograph, at magnification, the surface of the latent image carrier after transfer of the toner image from the latent image carrier onto either the recording medium or the intermediate transfer body, or a surface of the intermediate transfer body after transfer of the toner image from the intermediate transfer body onto the recording medium; and a control unit to control one or more image forming conditions based on a quantified value for residual toner of a detection pattern obtained by forming the detection pattern and photographing a portion of the surface of the latent image carrier or the intermediate transfer body on which the detection pattern is formed after transfer of the detection pattern from the latent image carrier onto the recording medium or the intermediate transfer body or after transfer of the detection pattern from the intermediate transfer body onto the recording medium using the post-transfer imaging unit. The quantified value represents the amount of residual toner of the detection pattern attached to either the surface of the latent image carrier or the intermediate transfer body based on a photographed image of the detection pattern.

Another illustrative embodiment provides a control method for controlling the image forming apparatus described above. The control method includes forming a detection pattern on the surface of the latent image carrier or the intermediate transfer body; transferring the detection pattern from the latent image carrier onto the recording medium or the intermediate transfer body or from the intermediate transfer body onto the recording medium; photographing, at magnification, the detection pattern after transfer using the post-transfer imaging unit to obtain a photographed image; quantifying the amount of residual toner in the detection pattern in the photographed image; and controlling one or more image forming conditions of the image forming apparatus, including at least one of a rotational velocity of the latent image carrier, a rotational velocity of the intermediate transfer body, a primary transfer current, and a secondary transfer current.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
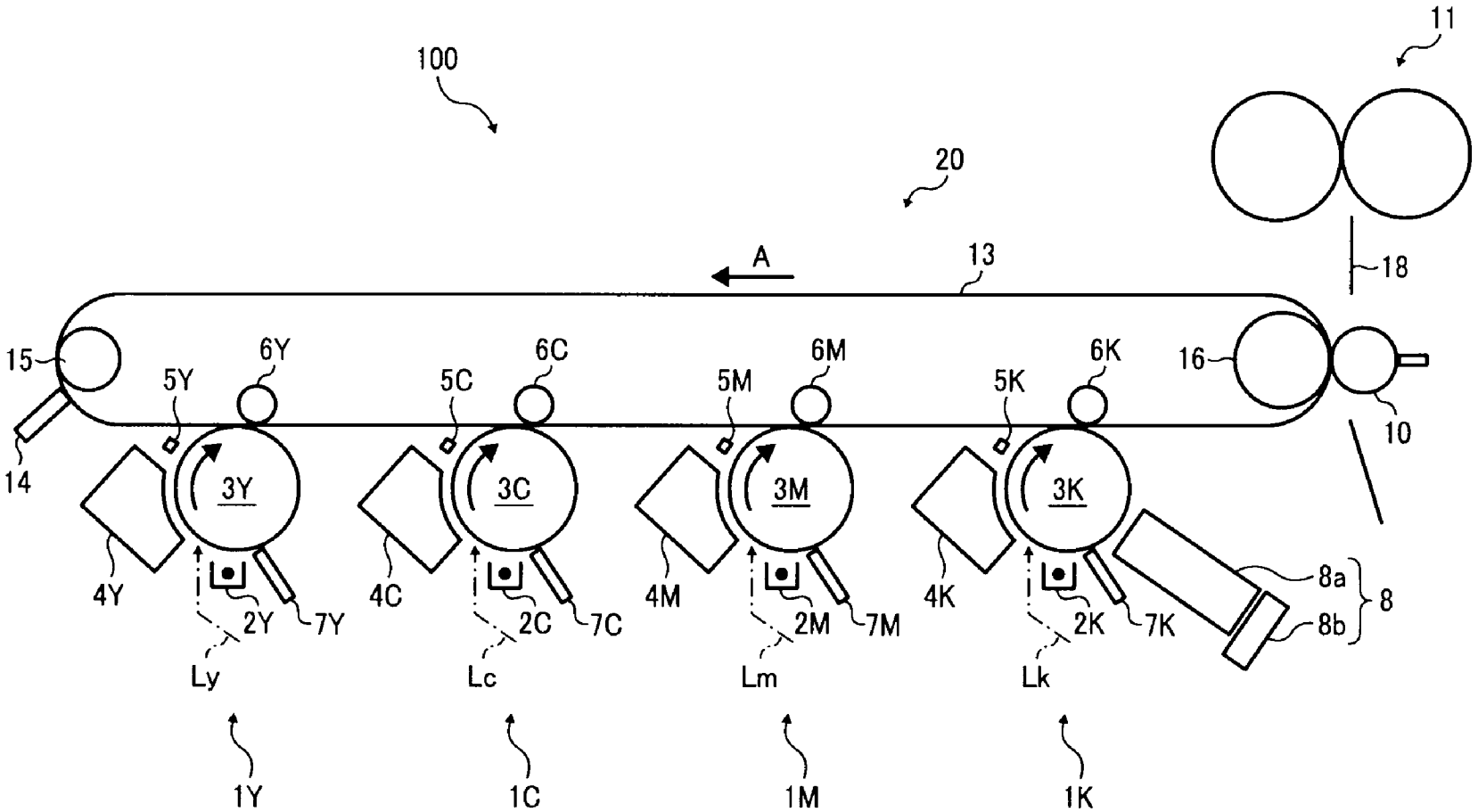
FIG. 1 is a schematic view illustrating an example of a configuration of main components of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of a full-color laser printer employing an electrophotographic method serving as an image forming apparatus 100 according to illustrative embodiments.

FIG. 1 is a schematic view illustrating an example of a configuration of main components of the image forming apparatus 100 according to a first illustrative embodiment. The image forming apparatus 100 includes four image forming units 1Y, 1C, 1M, and 1K (hereinafter collectively referred to as image forming units 1) each forming an image of a specific color, that is, yellow (Y), cyan (C), magenta (M), or black (K). The image forming units 1Y, 1C, 1M, and 1K are arranged in that order, from upstream to downstream in a direction indicated by arrow A in FIG. 1, that is, a direction of rotation of an intermediate transfer belt 13 serving as an intermediate transfer body. The image forming units 1 respectively include drum-type photoconductors 3Y, 3C, 3M, and 3K, each serving as a latent image carrier (hereinafter collectively referred to as photoconductors 3), chargers 2Y, 2C, 2M, and 2K (hereinafter collectively referred to as chargers 2), developing devices 4Y, 4C, 4M, and 4K (hereinafter collectively referred to as developing devices 4), cleaning blades 7Y, 7C, 7M, and 7K (hereinafter collectively referred to as cleaning blades 7), and so forth. The image forming units 1 are positioned such that rotary shafts of the photoconductors 3 are parallel to one another at predetermined intervals in the direction of rotation of the intermediate transfer belt 13.

Above the image forming units 1, a transfer device 20 including at least the intermediate transfer belt 13 is provided. According to the first illustrative embodiment, the transfer device 20 further includes four primary transfer rollers 6Y, 6C, 6M, and 6K (hereinafter collectively referred to as primary transfer rollers 6), a secondary transfer roller 10, a belt cleaning blade 14, and so forth. The intermediate transfer belt 13 is formed of a polyimide resin, and is stretched between two rollers 15 and 16. Either one of the rollers 15 and 16 can function as a driving roller to which a driving force is transmitted from a driving source, not shown.

In the image forming units 1, surfaces of the photoconductors 3 are rotated in a clockwise direction in FIG. 1 by a driving source, not shown, and are evenly charged by the chargers 2, respectively. Laser beams Ly, Lc, Lm, and Lk (hereinafter collectively referred to as laser beams L) each having image data of a specific color, that is, yellow, cyan, magenta, or black, are directed onto the charged surfaces of the photoconductors 3, respectively, from an optical unit, not shown, to form latent images of the respective colors on the surfaces of the photoconductors 3. The latent images thus formed are then developed by the developing devices 4 with toner of the specific color to form toner images on the surfaces of the photoconductors 3, respectively. Subsequently, the toner images thus formed on the surfaces of the photoconductors 3 are primarily transferred sequentially by the primary transfer rollers 6 onto the intermediate transfer belt 13 that is rotated in a counterclockwise direction in FIG. 1 and superimposed one atop the other to form a full-color toner image on the intermediate transfer belt 13. At this time, the toner images of the respective colors are primarily transferred from the surfaces of the photoconductors 3 onto the intermediate transfer belt 13 at a different timing from upstream to downstream in the direction of rotation of the intermediate transfer belt 13, such that each of the toner images is primarily transferred onto the same position on the intermediate transfer belt 13 in a superimposed manner. Thereafter, the surfaces of the photoconductors 3 are cleaned by the cleaning blades 7, respectively, to be ready for the next image formation sequence.

The full-color toner image formed on the intermediate transfer belt 13 is conveyed to a secondary transfer position formed between the intermediate transfer belt 13 and the secondary transfer roller 10 along with rotation of the intermediate transfer belt 13. Meanwhile, a recording medium such as a sheet of paper supplied from a sheet feed cassette, not shown, is conveyed to a pair of registration rollers, not shown, and then conveyed to the secondary transfer position at a predetermined timing by the pair of registration rollers. Accordingly, the full-color toner image formed on the intermediate transfer belt 13 is secondarily transferred onto the sheet by the secondary transfer roller 10 to form a full-color image on the sheet. In the first illustrative embodiment, the secondary transfer roller 10 is pressed against the roller 16 to which a bias is applied to secondarily transfer the full-color toner image formed on the intermediate transfer belt 13 onto the sheet. Alternatively, a bias may be applied to the secondary transfer roller 10. The sheet having the full-color image thereon is then conveyed to a fixing device 11 through a conveyance path 18 so that the full-color image is fixed onto the sheet by the fixing device 11. Thereafter, the sheet having the fixed full-color image thereon is discharged to a discharge tray, not shown. Meanwhile, after secondary transfer of the full-color toner image from the intermediate transfer belt 13 onto the sheet, the intermediate transfer belt 13 is cleaned by the belt cleaning blade 14.

Detectors 5Y, 5C, 5M, and 5K (hereinafter collectively referred to as detectors 5) each detecting a toner density and a position of a line image formed on the surfaces of the photoconductors 3 are provided between the developing devices 4 and primary transfer positions formed between the photoconductors 3 and the primary transfer rollers 6 in the image forming units 1, respectively. In the image forming unit 1K positioned on the extreme downstream side in the direction of rotation of the intermediate transfer belt 13, an imaging unit 8 serving as a post-transfer imaging unit that photographs the surface of the photoconductor 3K after the toner image of black is primarily transferred onto the intermediate transfer belt 13 is provided. Specifically, the imaging unit 8 is positioned downstream from the primary transfer position and upstream from the cleaning blade 7K in the direction of rotation of the photoconductor 3K. The imaging unit 8 includes a microscope 8*a*, a camera 8*b*, a light source, not shown, and so forth. According to the first illustrative embodiment, Ricoh R8 manufactured by Ricoh Company, Ltd. is used as the camera 8*b*, and DS-100 series, with a magnification of 100×, manufactured by Microadvance Co., Ltd. is used as the microscope 8*a*. A built-in autofocusing system of the camera 8*b* is used for adjusting the focus of the camera 8*b*. The imaging unit 8 is positioned such that the center of the surface of the photoconductor 3K in a main scanning direction, that is, a direction of a shaft of the photoconductor 3K, is photographed. It is to be noted that, alternatively, multiple imaging units 8 may be provided in the image forming unit 1K in the main scanning direction, or the imaging unit 8 may be movably provided in the image forming unit 1K to move in the main scanning direction.

The image forming apparatus 100 controls operation of each component using a control unit, not shown, including a central processing unit (CPU) serving as an operation unit, a random access memory (RAM) and a read-only memory (ROM) each serving as a data storage unit, and so forth. The control unit switches operating modes of the image forming apparatus 100 from a print mode to an adjustment mode to perform process control, correction of a line image, and so forth, immediately after the image forming apparatus 100 is turned on or each time images are formed on a predetermined number of sheets.

During process control, a toner density and displacement of images are corrected. Specifically, a gradation pattern image and a displacement detection image are formed on each of the photoconductors 3. The gradation pattern image is formed of multiple patch images each having different toner amounts or image density. The displacement detection image has a shape such as a right triangle so that a length of the displacement detection image in a sub-scanning direction, that is, the direction of rotation of the photoconductors 3, is different from that in the main scanning direction.

The amount of toner attached to each of the multiple patch images of the graduation pattern image formed on each of the photoconductors 3 is detected by each of the detectors 5. An equation for calculating developing characteristics of the developing devices 4 of y=ax+b is obtained based on the amount of toner detected by the detectors 5. Image forming conditions for the image forming units 1 such as an amount of bias applied to the chargers 2 and an amount of developing bias are adjusted based on a slope a in the above-described equation.

Further, a detection time taken for each of the detectors 5 to detect the displacement detection images is measured. When there is no displacement in the main scanning direction, the detection time is equal to a reference time. By contrast, when there is displacement in the main scanning direction, the detection time may be longer or shorter than the reference time. A timing to direct the laser beams L onto the surfaces of the photoconductors 3 from the optical unit, not shown, is adjusted based on a difference between the reference time and the detection time.

Figure 2:
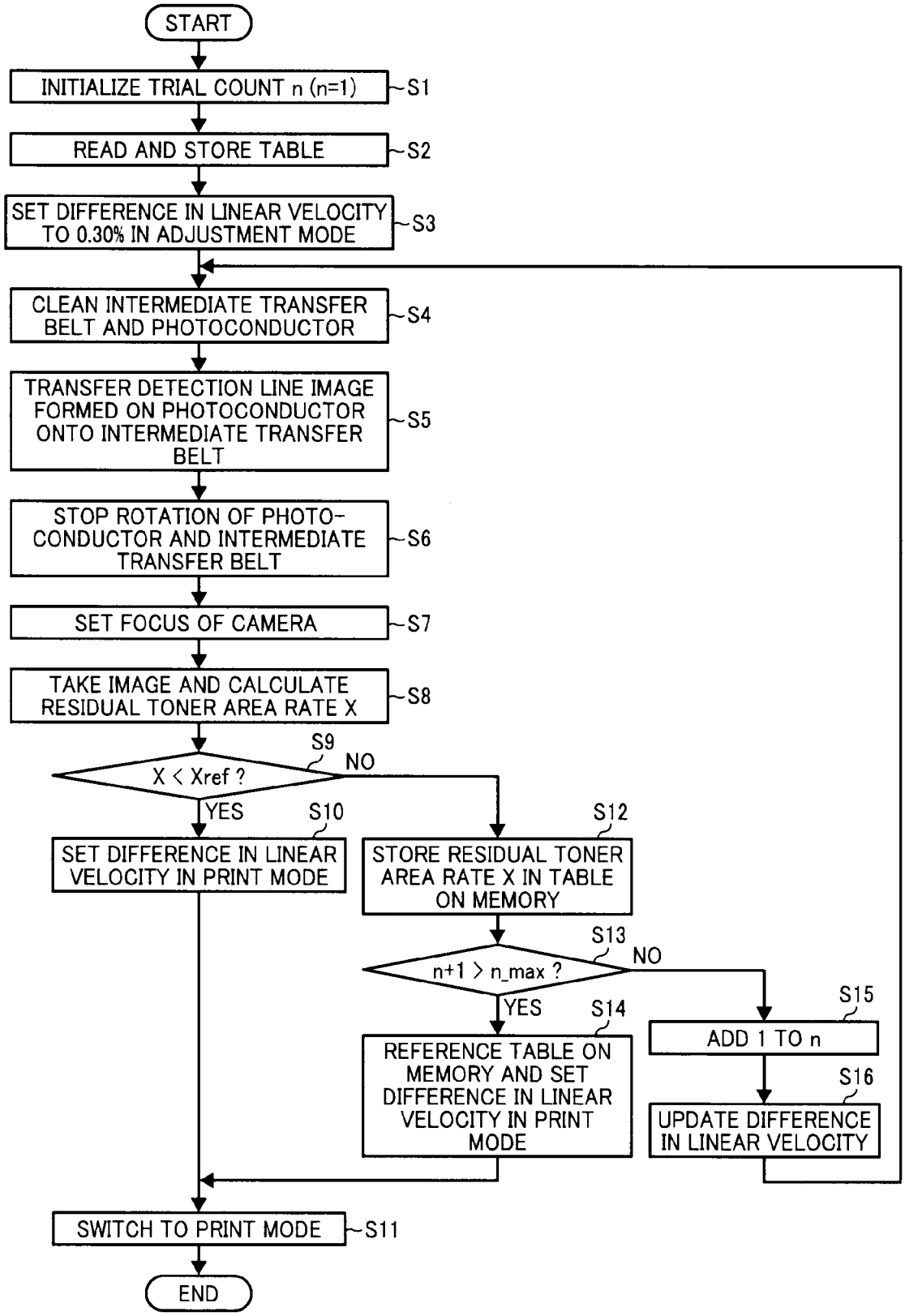
FIG. 2 is a flowchart illustrating steps in a process of correcting a line image according to the first illustrative embodiment.

After process control is completed, correction of line images is performed. FIG. 2 is a flowchart illustrating steps in a process of correcting line images according to the first illustrative embodiment. In the first illustrative embodiment, a difference in linear velocity between the photoconductor 3K and the intermediate transfer belt 13 (hereinafter simply referred to as a difference in linear velocity) is corrected to control the image forming conditions of the image forming apparatus 100. It is to be noted that the differences in linear velocity during correction of line images and that in the print mode are separately stored in the ROM in the control unit, not shown.

When process control is completed, at S1 the control unit inputs 1 as a trial count n to initialize the trial count. At S2, the control unit reads out a table like that shown as Table 1 below from the ROM and stores the table in the RAM.

TABLE 1

| Trial Count n | Difference in Linear Velocity | Measurement Value X |
|---|---|---|
| 1 | 0.30% | |
| 2 | 0.35% | |
| 3 | 0.25% | |
| 4 | 0.20% | |
| 5 | 0.15% | |

As shown in Table 1, the trial count n and the difference in linear velocity to be set are associated with each other in the table. Results obtained by performing subsequent processes, that is, the measurement values X, are further associated with the trial count n and the difference in linear velocity later and stored. It is to be noted that the difference in linear velocity is expressed as a percentage of the linear velocity of the intermediate transfer belt 13 of a difference, or value, obtained by subtracting the linear velocity of the photoconductor 3K from the linear velocity of the intermediate transfer belt 13. Next, at S3, the control unit reads a difference in linear velocity corresponding to the trial count n=1, that is, 0.30%, from the table stored in the RAM and sets a difference in linear velocity in the adjustment mode to 0.30%. In the first illustrative embodiment, the linear velocity of the intermediate transfer belt 13 is changed to adjust for the difference in linear velocity between the intermediate transfer belt 13 and the photoconductor 3K, and the linear velocity of the photoconductor 3K is fixed at 210 mm/sec. Therefore, in order to set the difference in linear velocity in the adjustment mode to 0.30%, the linear velocity of the intermediate transfer belt 13 is adjusted to 210.36 mm/sec.

At S4, each of the photoconductor 3K and the intermediate transfer belt 13 is rotated at least one revolution to clean the surfaces of the intermediate transfer belt 13 and the photoconductor 3K. At S5, a detection line image is formed at the center of the surface of the photoconductor 3K in the main scanning direction and then is transferred onto the intermediate transfer belt 13. A width of the detection line image in the main scanning direction is set to 5 dots. It is to be noted that cleaning means for cleaning the primary transfer roller 6K may be provided to clean the primary transfer roller 6K while the surfaces of the intermediate transfer belt 13 and the photoconductor 3K are cleaned.

At S6, rotation of the photoconductor 3K and the intermediate transfer belt 13 is stopped to stop formation of the detection line image when a portion on the surface of the photoconductor 3K on which the detection line image was formed faces the imaging unit 8. In the first illustrative embodiment, detection line images are consecutively formed so that timing to stop rotation of the photoconductor 3K may not be strictly controlled, thereby facilitating control to stop rotation of the photoconductor 3K. Further, because displacement of images in the main scanning direction is corrected during process control as described above, the portion on the surface of the photoconductor 3K on which the detection line image was formed can be reliably positioned in a photographing range of the imaging unit 8. According to the first illustrative embodiment, rotation of the photoconductor 3K is stopped 2 seconds after the start of formation of the detection line image. It is to be noted that, instead of forming the detection line image until rotation of the photoconductor 3K is stopped, a length of the detection line image in the sub-scanning direction may be set to a predetermined length and an optimal timing to stop rotation of the photoconductor 3K may be calculated to accurately stop rotation of the photoconductor 3K at the optimal timing thus calculated. As a result, excess toner consumption can be prevented.

At S7, the light source, not shown, of the imaging unit 8 is turned on, and the focus of the camera 8*b* is set using the autofocusing system. When focusing is completed and a completion signal is received, the camera 8*b* photographs the portion on the surface of the photoconductor 3K on which the detection line image was formed. At S8, the image photographed by the camera 8*b* is directly forwarded to the RAM for processing by the CPU.

Processing of the image photographed by the imaging unit 8 performed at S8 is described in detail below.

Examples of processing of photographed images include, but are not limited to, quantification of an image using values of RGB for each dot based on, for example, an equation of $X=(R+1)\times(G+1)\times(B+1)$; quantification of an image by digitizing the image by referring to a preset reference; and digitization of an image by automatically deciding a reference based on the image or a preset rule. In the first illustrative embodiment, the image photographed by the imaging unit 8 is quantified by digitizing the image referring a preset reference.

The reference referred to when digitizing the image is obtained as follows. First, a sample image is displayed using Image-Pro Plus manufactured by Media Cybernetics Inc., and values of RGB at portions in which toner attachment is visually confirmed are stored. The multiple values of RGB thus stored are stored in the ROM as the reference.

In image processing, the image photographed by the imaging unit 8 is divided into pixels, and it is determined whether or not the values of RGB for each pixel correspond to one of the multiple values of RGB stored as the reference in the ROM. When the values of RGB for a pixel correspond to one of the multiple values of RGB stored as the reference in the ROM, that pixel is recognized as being a toner portion. When the values of RGB for a pixel do not correspond to one of the multiple values of RGB stored as the reference in the ROM, that pixel is recognized as being a non-toner portion. The above-described determination and recognition are performed for all of the pixels so that the image photographed by the imaging unit 8 is automatically divided into the toner portion and the non-toner portion and digitized. Subsequently, the control unit calculates an area of the toner portion based on the image thus digitized to obtain a residual toner area W, in which toner of the detection line image that is not transferred onto the intermediate transfer belt 13 remains on the surface of the photoconductor 3K. Based on the residual toner area W, a residual toner area rate X is calculated using an equation of X=W/(Total Area of Photographed Image). Alternatively, the residual toner area rate X may be calculated based on an optical written area using an equation of X=W/(Optical Written Area).

At S9, image quality is determined based on the residual toner area rate X in which the residual toner of the detection line image is quantified as described above. Specifically, the residual toner area rate X is compared to an upper limit Xref to determine image quality. It is to be noted that the upper limit Xref is determined in advance and is set to 0.050 in the first illustrative embodiment. In a case in which the residual toner area rate X is calculated based on the optical written area, Xref is set to 0.040.

When the residual toner area rate X is smaller than the upper limit Xref (YES at S9), the process proceeds to S10. At S10, it is determined that the detection line image has no white spots and no problem with image quality, and the difference in linear velocity between the intermediate transfer belt 13 and the photoconductor 3K in the print mode is set to that currently set in the adjustment mode, that is, 0.30%. At S11, the control unit switches the operating mode from the adjustment mode to the print mode.

By contrast, when the residual toner area rate X is greater than the upper limit Xref (NO at S9), the process proceeds to S12. At S12, it is determined that the detection line image may include white spots and may have a problem with image quality, and the residual toner area rate X calculated as described above is stored as a measurement value X on a line of the trial count n=1 in the table like that shown as Table 1 above stored in the RAM (hereinafter referred to as a table on memory). At S13, the control unit determines whether or not the trial count n+1 is greater than the maximum trial count (n_max=5) in the table on memory. When the trial count n+1 is not greater than the maximum trial count (n_max=5) in the table on memory (NO at S13), the process proceeds to S15 to add 1 to the trial count n. At S16, the difference in linear velocity is updated for the corresponding trial count n based on the table on memory, and the process returns to S4 to perform the subsequent steps.

Here, because the trial count n currently used is 1, and n+1 is not greater than the maximum trial count, that is 5, the trial count n is updated to 2 at S15, and the linear velocity of the intermediate transfer belt 13 is adjusted such that the difference in linear velocity between the photoconductor 3K and the intermediate transfer belt 13 is set to 0.35% corresponding to the trial count n of 2 at S16. Thereafter, the process returns to S4 to perform the subsequent processes. At S8 for the second trial, the residual toner area rate X, that is, an amount of residual toner of the detection line image, is calculated again as described above. When the residual toner area rate X with the difference in linear velocity of 0.35% is smaller than the upper limit Xref (YES at S9), the process proceeds to S10 and the difference in linear velocity between the photoconductor 3K and the intermediate transfer belt 13 in the print mode is set to 0.35%. At S11, the control unit switches the operating mode from the adjustment mode to the print mode. By contrast, when the residual toner area rate X for the second trial is greater than the upper limit Xref (NO at S9), the process proceeds to S12 and the residual toner area rate X corresponding to the difference in linear velocity of 0.35% is stored as a measurement value X in the table on memory. Thereafter, the trial count n is updated to 3 at S15. The above-described processes are repeated until the residual toner area rate X becomes smaller than the upper limit Xref.

When the trial count n is equal to 5, that is, the maximum trial count (n_max=5) in the table on memory (YES at S13), all of the measurement values X in the table on memory are filled as shown in Table 2 below. At S14, the control unit references the table on memory to acquire a difference in linear velocity between the photoconductor 3K and the intermediate transfer belt 13 corresponding to the minimum value of the residual toner area rate X in the table on memory, and sets the difference in linear velocity thus acquired as a difference in linear velocity in the print mode. For example, in Table 2 below, the residual toner area rate X is minimum when the trial count n is 2. Accordingly, the difference in linear velocity between the photoconductor 3K and the intermediate transfer belt 13 in the print mode is set to 0.35%.

TABLE 2

| Trial Count n | Difference in Linear Velocity | Measurement Value X |
|---|---|---|
| 1 | 0.30% | 0.078 |
| 2 | 0.35% | 0.052 |
| 3 | 0.25% | 0.092 |
| 4 | 0.20% | 0.081 |
| 5 | 0.15% | 0.099 |

As described above, the imaging unit 8 that photographs the image at magnification is provided as a detector to detect the residual toner on the surface of the photoconductor 3K. Accordingly, the amount of residual toner of the detection line image having a width of several dots in the main scanning direction can be quantified. As a result, the difference in linear velocity between the photoconductor 3K and the intermediate transfer belt 13 can be optimally set to prevent white spots in the line image based on the residual toner area rate X calculated as described above.

It is to be noted that, in the print mode, the linear velocity of the photoconductor 3K is adjusted to set the difference in linear velocity as set in correction of the line image. Although the difference in linear velocity between the photoconductor 3K and the intermediate transfer belt 13 is controlled to prevent white spots in the line image as in the above description, alternatively, for example, a primary transfer current or voltage may be controlled to prevent white spots in the line image. Further alternatively, image forming conditions, such as a charging bias, the output from LED, and a developing bias, may be controlled to adjust an amount of toner attached to the detection line image based on the residual toner area rate X to prevent white spots in the line image. As described above, when the residual toner area rate X is smaller than the upper limit Xref, the difference in linear velocity at that time is set as the difference in linear velocity in the print mode, and then the adjustment mode is completed. Alternatively, trials may be performed for 5 times to set a difference in linear velocity corresponding to the trial count n having the minimum residual toner area rate X as the difference in linear velocity in the print mode.

The imaging unit 8 photographs the surface of the photoconductor 3K at magnification after primary transfer as described above, so that even a slight amount of residual toner attached to the surface of the photoconductor 3K after primary transfer can be accurately detected. Accordingly, a line image that causes only a slight amount of residual toner on the surface of the photoconductor 3K after primary transfer is used as a pattern for detection to accurately detect transfer performance of the line image in the image forming apparatus 100. As a result, the image forming conditions that prevent white spots in the line image can be accurately adjusted, thereby achieving higher-quality images.

Figure 3:
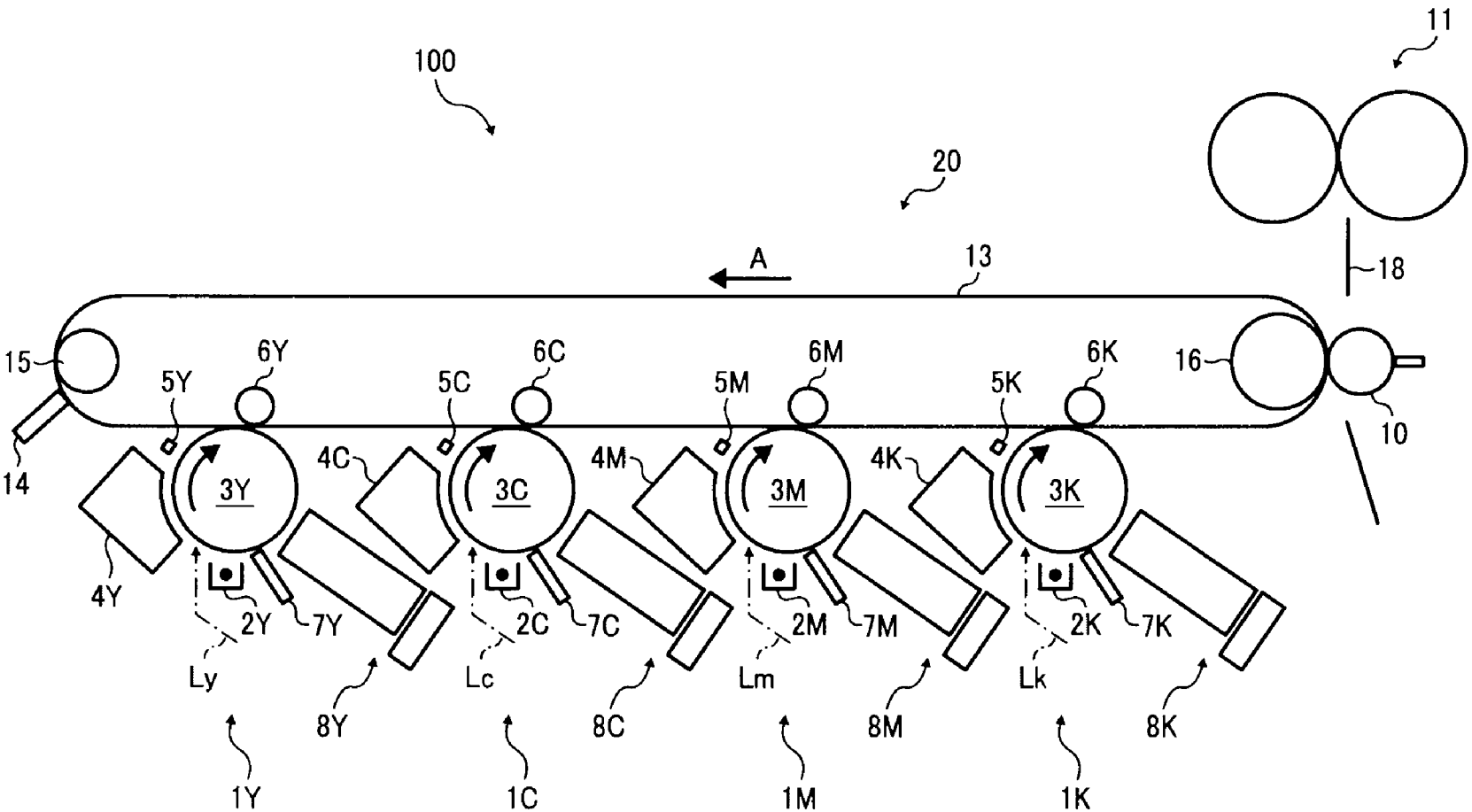
FIG. 3 is a schematic view illustrating another example of a configuration of main components of the image forming apparatus according to the first illustrative embodiment.

Although the imaging unit 8 is provided only in the image forming unit 1K as illustrated in FIG. 1 in order to prevent white spots in a line image of black, alternatively, multiple imaging units 8Y, 8C, 8M, and 8K may be provided in the image forming units 1, respectively, as illustrated in FIG. 3 in order to prevent white spots in line images of all the colors of yellow, cyan, magenta, and black. In such a case, correction of line images described above is performed by all of the image forming units 1, respectively. Further, the linear velocity of the intermediate transfer belt 13 is kept constant and the linear velocity of each of the photoconductors 3 is adjusted to make a difference in linear velocity between the intermediate transfer belt 13 and the photoconductors 3 as set. Accordingly, the trial can be performed in the image forming units 1, respectively, with the difference in linear velocity independently set. The adjustment mode is completed when the difference in linear velocity between the intermediate transfer belt 13 and the photoconductors 3 in the print mode is set in each of the image forming units 1. Alternatively, the trial may be continuously performed in the corresponding image forming units 1 in which the difference in linear velocity in the print mode has been already set to obtain a difference in linear velocity that achieves the minimum residual toner area rate X.

Although the toner images formed on the surfaces of the photoconductors 3 are primarily transferred onto the intermediate transfer belt 13 and then are secondarily transferred onto the sheet from the intermediate transfer belt 13 in the image forming apparatus 100 employing an intermediate transfer method as described above, the present illustrative embodiment is equally applicable to a tandem type image forming apparatus employing a direct transfer method, in which toner images formed on surfaces of photoconductors are directly transferred onto the recording medium.

A description is now given of a width of the detection line image in the main scanning direction.

From an experiment, it has been found that detection sensitivity is increased depending on a width of a detection line image.

In the experiment, first, line images having a width of dots were formed under different image forming conditions to visually evaluate levels of white spots in the line images for each of the image forming condition. The levels of white spots in the line images were then sorted into 5 ranks from Ranks 1 to 5.

Specifically, Rank 5 indicates that no white spots are found in the line image. Rank 4 indicates that, although a slight amount of white spots are found, most of them are not visually confirmed. Rank 3 indicates that white spots that can be visually confirmed are found in the line image. Rank 2 indicates that white spots are prominent in the line image. Rank 1 indicates that some parts of the line image are not clear due to white spots.

The width of the detection line image was changed under each of the image forming conditions to examine a relation between the residual toner area rate X calculated as described above and the levels of the white spots. Results are shown in Table 3 below and FIG. 4.

TABLE 3

| | | Levels of White Spots | | | | |
|---|---|---|---|---|---|---|
| | Width | 5 | 4 | 3 | 2 | 1 |
| Residual Toner Area Rate (%) | 1 dot | 0.000 | 0.000 | 0.000 | 0.000 | 0.120 |
| | 2 dots | 0.000 | 0.000 | 0.000 | 0.110 | 0.130 |
| | 3 dots | 0.000 | 0.039 | 0.090 | 0.230 | 0.350 |
| | 4 dots | 0.010 | 0.042 | 0.159 | 0.320 | 0.349 |
| | 5 dots | 0.040 | 0.129 | 0.351 | 0.590 | 0.600 |
| | 6 dots | 0.001 | 0.034 | 0.219 | 0.491 | 0.510 |
| | 7 dots | 0.023 | 0.091 | 0.319 | 0.431 | 0.419 |
| | 8 dots | 0.091 | 0.231 | 0.590 | 0.671 | 0.769 |
| | 9 dots | 0.159 | 0.320 | 0.491 | 0.891 | 0.732 |
| | 10 dots | 0.019 | 0.209 | 0.607 | 0.790 | 0.773 |
| | 11 dots | 0.182 | 0.209 | 0.590 | 0.540 | 0.501 |
| | 12 dots | 0.204 | 0.391 | 0.401 | 0.499 | 0.475 |

Figure 4:
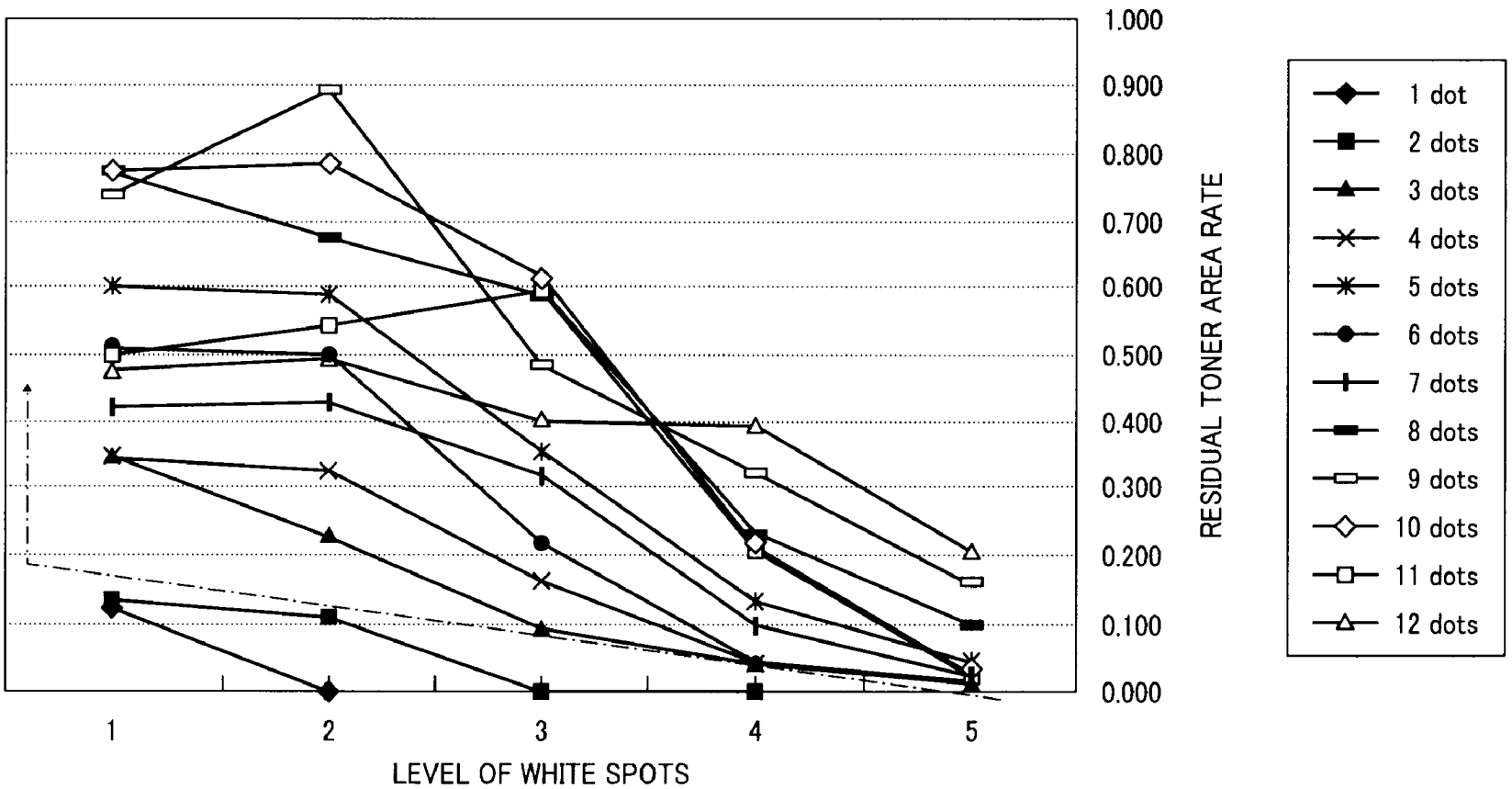
FIG. 4 is a graph illustrating a relation between levels of white spots and residual toner area rates.

As shown in Table 3 above and FIG. 4, the detection line image having a width of 1 dot has detection sensitivity only around Rank 1. Although detection sensitivity is slightly improved in the detection line image having a width of 2 dots, however, it has still a poorer evaluation result. By contrast, the detection line image having a width of 3 dots or greater can achieve acceptable detection sensitivity. Therefore, the levels of the white spots in the line image can be accurately detected based on the photographed image of the residual toner of the detection line image having a width of 3 dots or greater. It is to be noted that the broken line in FIG. 4 indicates a minimum acceptable level of detection.

A description is now given of a second illustrative embodiment of the present invention. A basic configuration of the image forming apparatus 100 according to the second illustrative embodiment is the same as that of the image forming apparatus 100 according to the first illustrative embodiment. Therefore, a description of the basic configuration of the image forming apparatus 100 according to the second illustrative embodiment is omitted.

Figure 5:
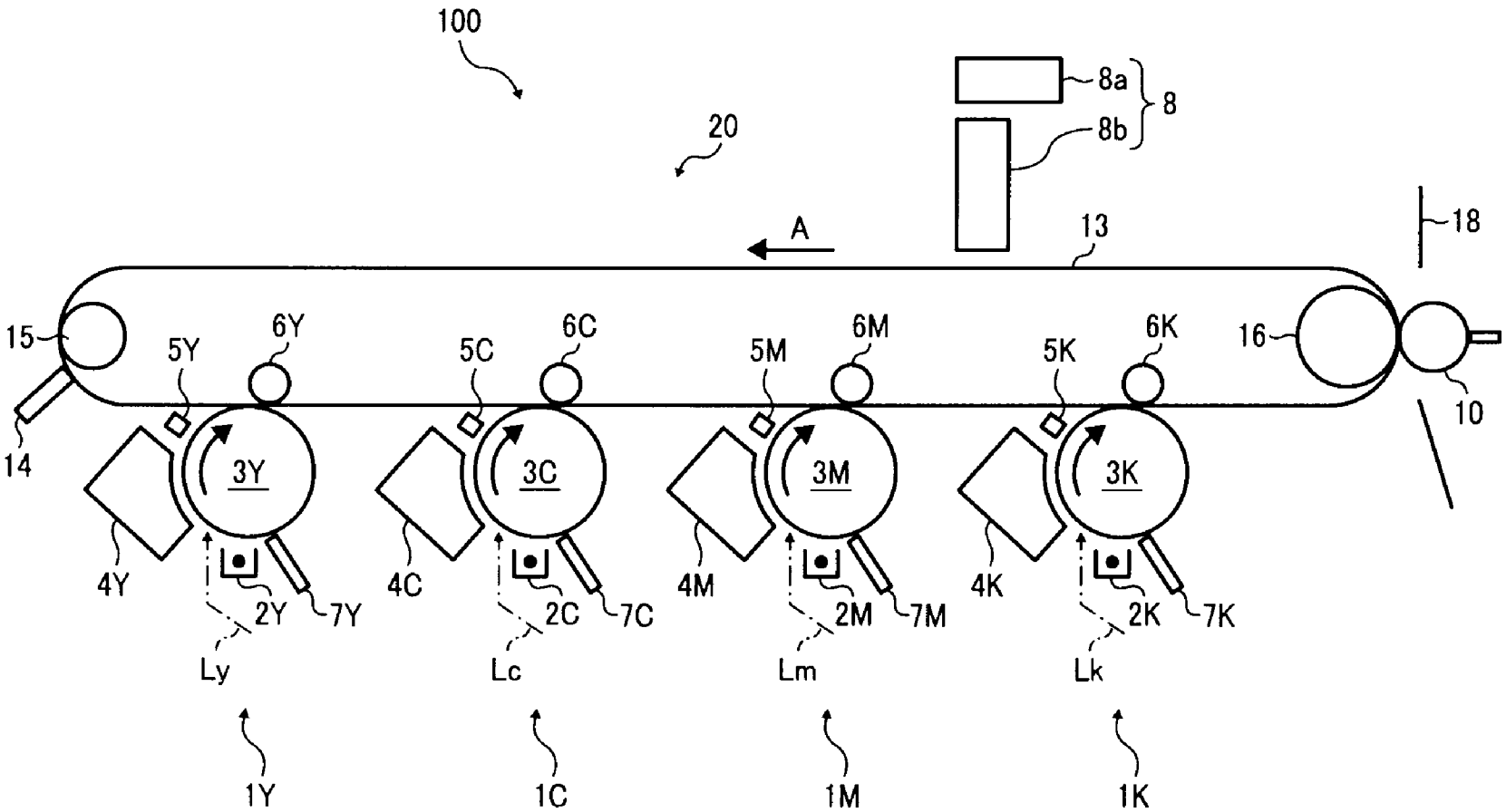
FIG. 5 is a schematic view illustrating a configuration of main components of an image forming apparatus according to a second illustrative embodiment.

FIG. 5 is a schematic view illustrating a configuration of main components of the image forming apparatus 100 according to the second illustrative embodiment. In the image forming apparatus 100 according to the second illustrative embodiment, the imaging unit 8 is provided, on the intermediate transfer belt 13, downstream from the secondary transfer position and upstream from the belt cleaning blade 14 in the direction of rotation of the intermediate transfer belt 13.

Figure 6:
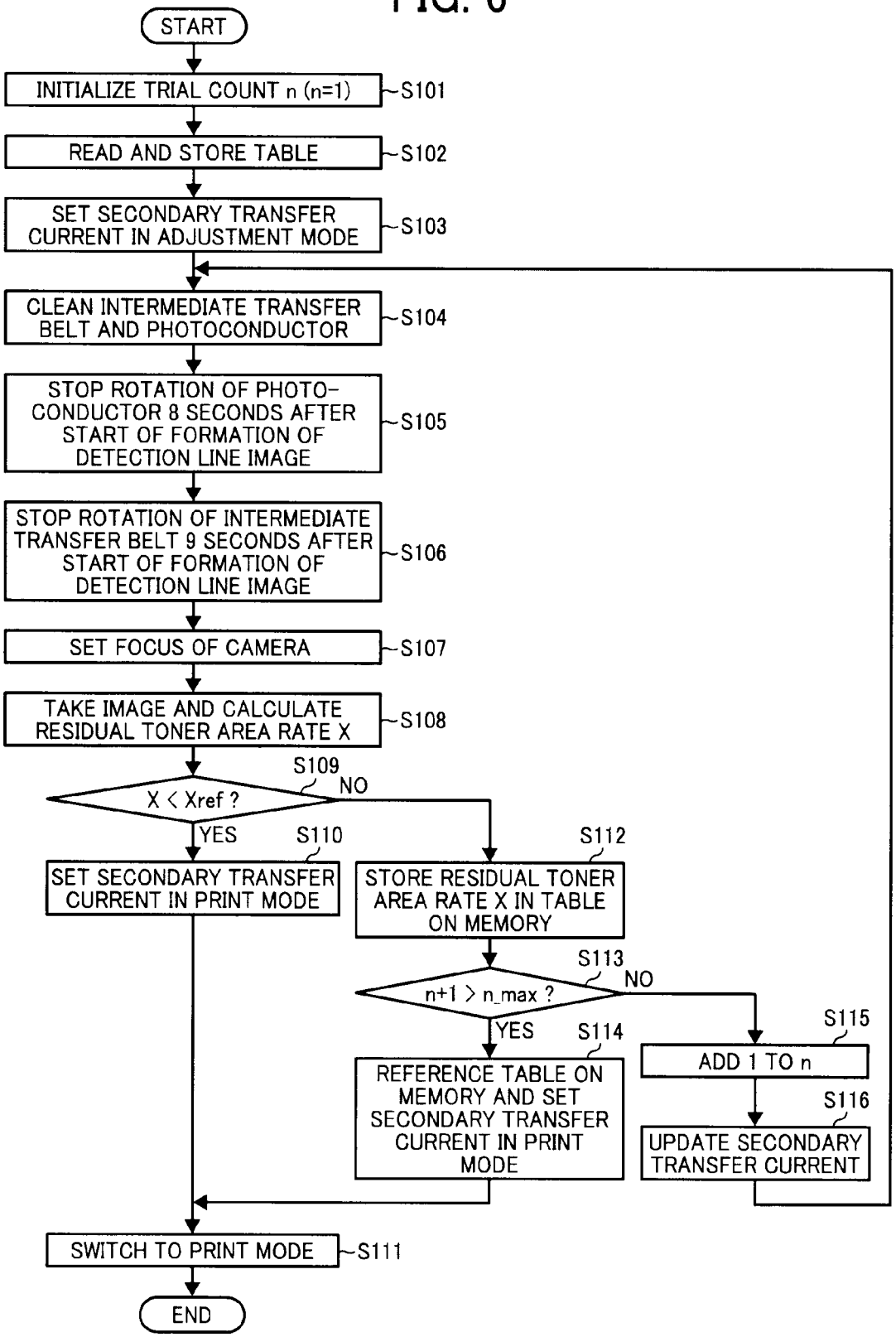
FIG. 6 is a flowchart illustrating steps in a process of correcting a line image according to the second illustrative embodiment.

FIG. 6 is a flowchart illustrating steps in a process of correcting a line image according to the second illustrative embodiment. Similarly to the first illustrative embodiment, after completion of process control, at S101, 1 is input as the trial count n to initialize the trial count. At S102, the control unit reads out a table like that shown as Table 4 below and stores the table in the RAM.

TABLE 4

| Trial Count n | Transfer Current [μA] | Measurement Value X |
|---|---|---|
| 1 | −42 | |
| 2 | −47 | |
| 3 | −37 | |

TABLE 4-continued

| Trial Count n | Transfer Current [μA] | Measurement Value X |
|---|---|---|
| 4 | −50 | |
| 5 | −35 | |

In the second illustrative embodiment, a secondary transfer current is corrected to control the image forming conditions of the image forming apparatus 100. Accordingly, as shown in Table 4 above, the trial count n and the secondary transfer current to be set are associated with each other. At S103, a secondary transfer current corresponding to the trial count n=1 is set as a secondary transfer current in the adjustment mode based on the table. At S104, each of the photoconductor 3K and the intermediate transfer belt 13 is rotated at least one revolution to clean the surfaces of the intermediate transfer belt 13 and the photoconductor 3K. Subsequently, a detection line image is formed at the center of the surface of the photoconductor 3K. The detection line image thus formed is primarily transferred onto the intermediate transfer belt 13 from the surface of the photoconductor 3K, and then is secondarily transferred onto a sheet from the intermediate transfer belt 13. Detection line images are consecutively formed so that a portion on the intermediate transfer belt 13 on which the detection line image was formed can be reliably positioned within a photographing range of the imaging unit 8 without strictly controlling a timing to stop rotation of the intermediate transfer belt 13. At S105, rotation of the photoconductor 3K is stopped 8 seconds after the start of formation of the detection line image. Thereafter, at S106, rotation of the intermediate transfer belt 13 is stopped 9 seconds after the start of formation of the detection line image.

It is to be noted that time taken until rotation of the photoconductor 3K and the intermediate transfer belt 13 is stopped is extended in the second illustrative embodiment compared to the first illustrative embodiment because the position of the imaging unit 8 is changed. As described above, in the second illustrative embodiment, the detection line image is formed by the image forming unit 1K positioned at the extreme downstream side in the direction of rotation of the intermediate transfer belt 13. Accordingly, time taken for residual toner of the detection line image attached to the intermediate transfer belt 13 to reach the imaging unit 8 after the start of formation of the detection line image can be shortened compared to a case in which the detection line image is formed by the image forming units 1 other than the image forming unit 1K. As a result, correction of the line image can be performed in a shorter period of time. Alternatively, the detection line image may be formed by the image forming units 1 other than the image forming unit 1K.

Thereafter, at S107, the light source, not shown, of the imaging unit 8 is turned on, and a focus of the camera 8*b* is set using the autofocusing system. When the focus of the camera 8*b* is set and a completion signal is received, at S108 the camera 8*b* of the imaging unit 8 photographs, at magnification, the portion of the intermediate transfer belt 13 onto which the detection line image was formed, and the image thus photographed by the camera 8*b* is directly forwarded to the RAM for processing by the CPU to calculate a residual toner area rate X in a similar manner as the first illustrative embodiment.

At S109, image quality is determined based on the residual toner area rate X thus calculated. Specifically, the residual toner area rate X is compared to an upper limit Xref to determine image quality. When the residual toner area rate X is smaller than the upper limit Xref (YES at S109), the process proceeds to S110. At S110, the secondary transfer current set at that time is set as a secondary transfer current in the print mode. At S111, the control unit switches the operating mode from the adjustment mode to the print mode.

By contrast, when the residual toner area rate X is greater than the upper limit Xref (NO at S109), the process proceeds to S112. At S112, it is determined that the line image may include white spots and may have a problem with image quality, and the residual toner area rate X calculated as described above is stored in a line of n=1 in the table on memory. At S113, the control unit determines whether or not the trial count n+1 is greater than the maximum trial count (n_max=5) in the table on memory. When the trial count n+1 is not greater than the maximum trial count (n_max=5) in the table on memory (NO at S113), the process proceeds to S115 to add 1 to the trial count n. At S116, the secondary transfer current is updated for the corresponding trial count n based on the table on memory, and the process returns to S104 to perform the subsequent steps for the next trial.

When the trial count n+1 is greater than the maximum trial count (n_max=5) (YES at S113), all of the measurement values X, that is, the residual toner area rates X, in the table on memory are filled. At S114, the control unit references the table on memory to acquire a secondary transfer current corresponding to the minimum residual toner area rate X, and sets the secondary transfer current thus acquired as a secondary transfer current in the print mode. Thereafter, the process proceeds to S111 to switch the operating mode from the adjustment mode to the print mode.

It is to be noted that, in the second illustrative embodiment, Xref is set to 0.045 which is stricter than the first illustrative embodiment, because it has been confirmed by experiment that the secondary transfer rate more easily affects generation of white spots in the line image compared to the primary transfer rate in the image forming apparatus 100. However, the value of Xref may be set the same as that in the first illustrative embodiment and still prevent white spots in the line image.

As described above, use of the imaging unit 8 that photographs residual toner on the intermediate transfer belt 13 at magnification can quantify the residual toner amount after the line image having a width of several dots in the main scanning direction is secondarily transferred onto the sheet from the intermediate transfer belt 13. Accordingly, an optimal value of the secondary transfer current that prevents white spots in the line image can be set based on the residual toner area rate X, that is, the amount of residual toner of the line image quantified as described above.

A description is now given of a third illustrative embodiment of the present invention. A basic configuration of the image forming apparatus 100 according to the third illustrative embodiment is the same as that of the image forming apparatus 100 according to the first and second illustrative embodiments. Therefore, only differences from the image forming apparatus 100 according to the first and second illustrative embodiments are described in detail below.

Figure 7:
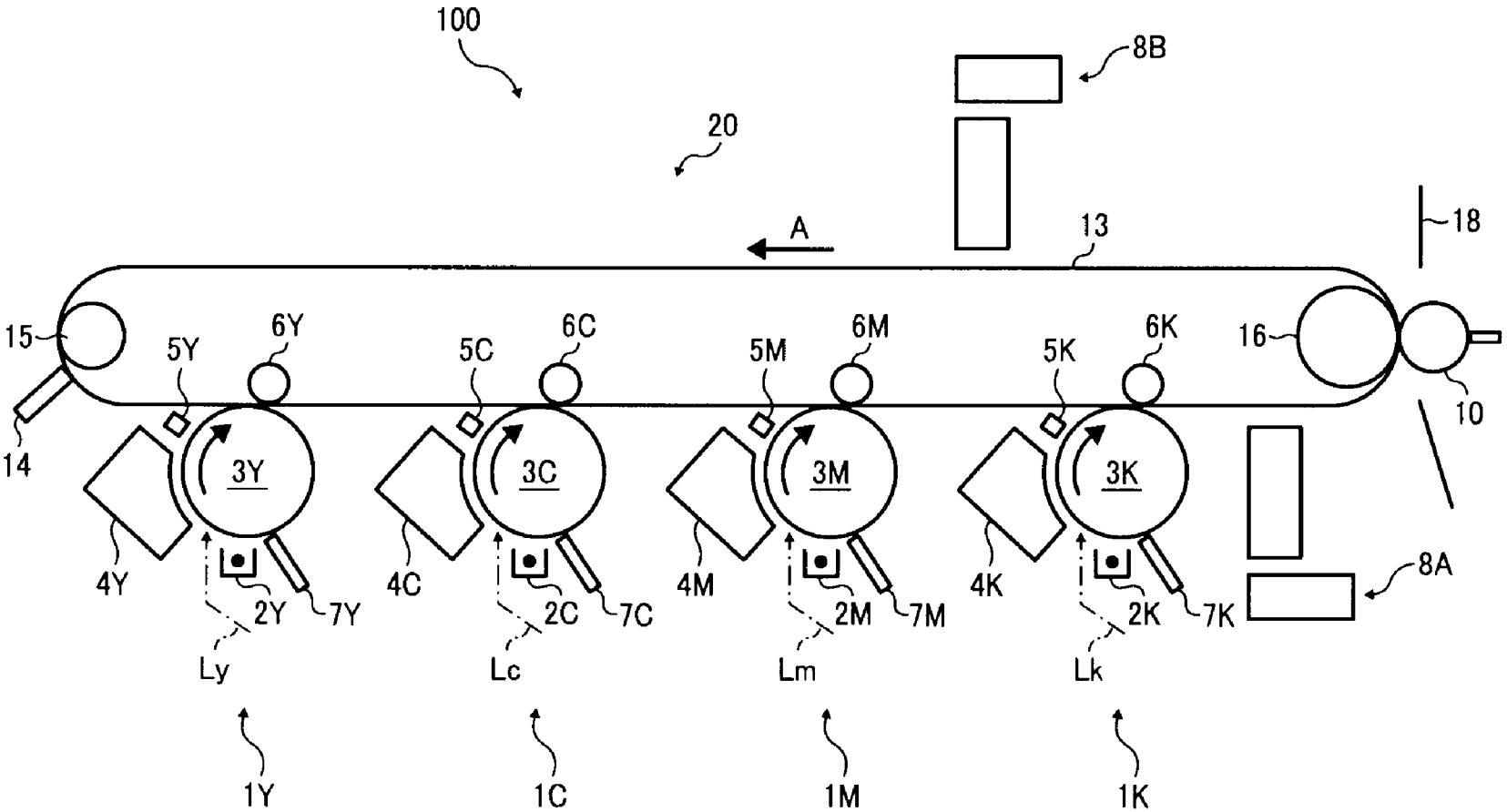
FIG. 7 is a schematic view illustrating a configuration of main components of an image forming apparatus according to a third illustrative embodiment.

FIG. 7 is a schematic view illustrating a configuration of main components of the image forming apparatus 100 according to the third illustrative embodiment. The image forming apparatus 100 according to the third illustrative embodiment includes a pre-transfer imaging unit 8A that photographs a detection line image formed on the intermediate transfer belt 13 before the detection line image is secondarily transferred onto a sheet from the intermediate transfer belt 13. The image forming apparatus 100 further includes a post-transfer imaging unit 8B that photographs residual toner of the detection line image attached to the intermediate transfer belt 13 after the detection line image is secondarily transferred onto the sheet from the intermediate transfer belt 13. The pre-transfer imaging unit 8A is provided downstream from the image forming unit 1K and upstream from the secondary transfer position in the direction of rotation of the intermediate transfer belt 13. The post-transfer imaging unit 8B is provided downstream from the secondary transfer position and upstream from the belt cleaning blade 14 in the direction of rotation of the intermediate transfer belt 13.

Figure 8:
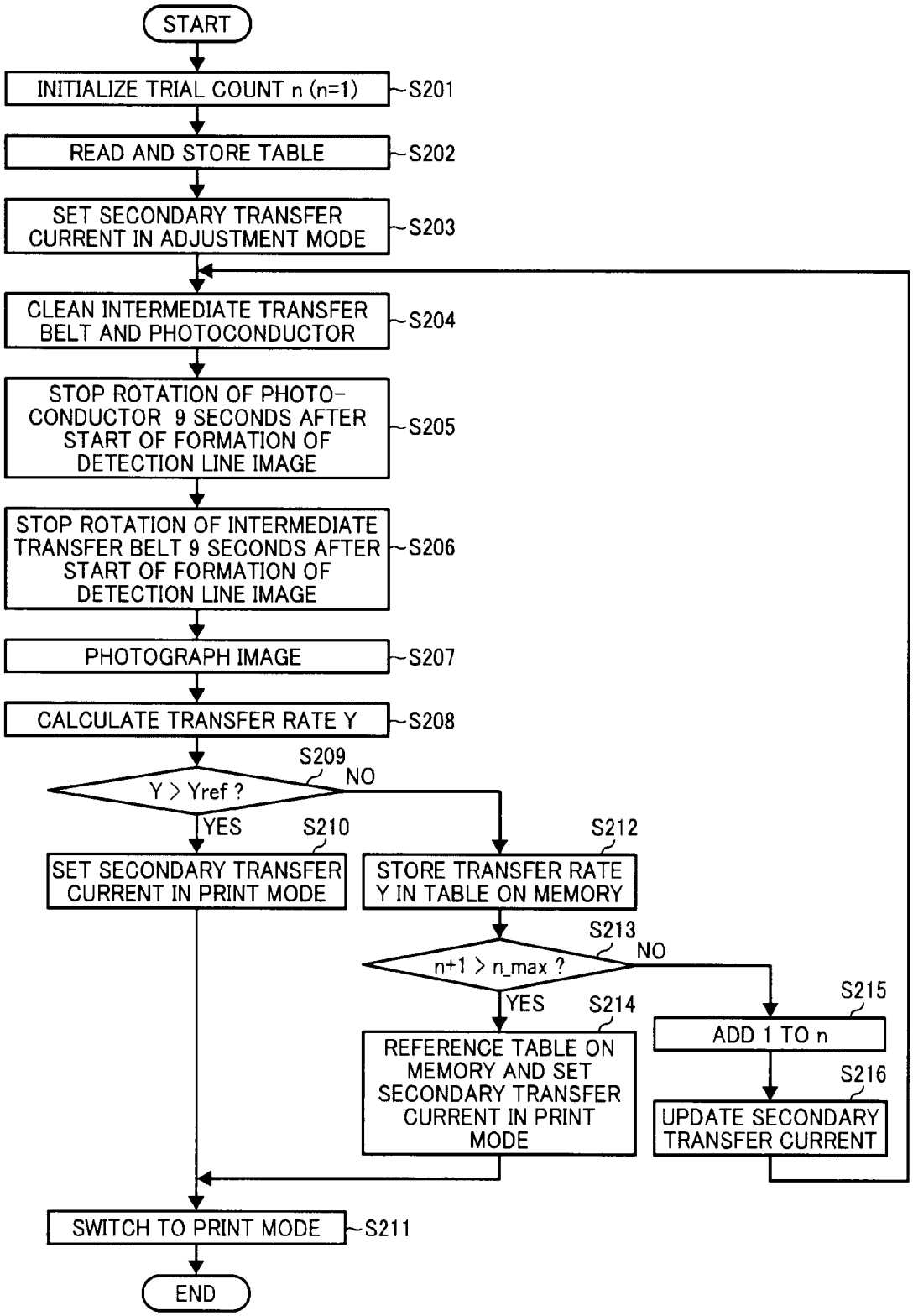
FIG. 8 is a flowchart illustrating steps in a process of correcting a line image according to the third illustrative embodiment.

FIG. 8 is a flowchart illustrating steps in a process of correcting a line image according to the third illustrative embodiment.

Similarly to the second illustrative embodiment, after completion of process control, at S201, 1 is input as the trial count n to initialize the trial count. At S202, the control unit reads out the table like that shown as Table 4 above and stores the table in the RAM. At S203, a secondary transfer current corresponding to n=1 is set as a secondary transfer current in the adjustment mode based on the table. At S204, each of the photoconductor 3K and the intermediate transfer belt 13 is rotated at least one revolution to clean the surfaces of the intermediate transfer belt 13 and the photoconductor 3K. Subsequently, a detection line image is formed at the center of the surface of the photoconductor 3K in the main scanning direction, and then the detection line image thus formed is primarily transferred onto the intermediate transfer belt 13 from the surface of the photoconductor 3K. At S205, rotation of the photoconductor 3K is stopped 9 seconds after the start of formation of the detection line image. At the same time, at S206, rotation of the intermediate transfer belt 13 is stopped 9 seconds after the start of formation of the detection line image.

In the third illustrative embodiment, differing from the second illustrative embodiment, rotation of the photoconductor 3K and the intermediate transfer belt 13 is stopped at the same time to photograph the detection line image formed by the image forming unit 1K provided at the extreme downstream position in the direction of rotation of the intermediate transfer belt 13 using the pre-transfer imaging unit 8A. Accordingly, the detection line image can be reliably positioned in a photographing range of the pre-transfer imaging unit 8A without strictly controlling a timing to stop rotation of the intermediate transfer belt 13.

Thereafter, a light source, not shown, of the pre-transfer imaging unit 8A is turned on, and a focus of a camera of the pre-transfer imaging unit 8A is set using an autofocusing system. When the focus of the camera is set and a completion signal is received, at S207 the camera of the pre-transfer imaging unit 8A photographs the detection line image formed on the intermediate transfer belt 13 at magnification. The detection line image is then secondarily transferred onto a sheet from the intermediate transfer belt 13. Thereafter, a camera of the post-transfer imaging unit 8B photographs, at magnification, the portion of the intermediate transfer belt 13 onto which the detection line image was formed, that is, residual toner of the detection line image after the detection line image is secondarily transferred onto the sheet.

At S208, the images respectively photographed by the pre-transfer imaging unit 8A and the post-transfer imaging units 8B are directly forwarded to the RAM and the images are processed by the CPU to calculate residual toner areas of each of the images. Further, a transfer rate Y is calculated based on the residual toner areas thus calculated using an equation of Y=[(Toner Area Before Secondary Transfer)−(Toner Area After Secondary Transfer)]/(Area of Photographing Range).

At S209, image quality is determined based on the transfer rate Y thus calculated. Specifically, the transfer rate Y is compared to a lower limit Yref to determine image quality. When the transfer rate Y is greater than the lower limit Yref (YES at S209), the process proceeds to S210. At S210, the secondary transfer current set at that time is set as a secondary transfer current in the print mode. At S211, the control unit switches the operating mode from the adjustment mode to the print mode.

By contrast, when the transfer rate Y is smaller than the lower limit Yref (NO at S209), the process proceeds to S212. At S212, it is determined that the line image may include white spots and may have a problem with image quality, and the transfer rate Y calculated as described above is stored in a line of n=1 in the table on memory as a measurement value. At S213, the control unit determines whether or not the trial count n+1 is greater than the maximum trial count (n_max=5) in the table on memory. When the trial count n+1 is not greater than the maximum trial count (n_max=5) in the table on memory (NO at S213), the process proceeds to S215 to add 1 to the trial count n. At S216, the secondary transfer current is updated for the corresponding trial count n based on the table on memory, and the process returns to S204 to perform the subsequent steps for the next trial.

When the trial count n+1 is greater than the maximum trial count (n_max=5) (YES at S213), all of the measurement values, that is, the transfer rates Y, in the table on memory are filled. At S214, the control unit references the table on memory to acquire a secondary transfer current corresponding to the maximum transfer rate Y, and sets the secondary transfer current thus acquired as a secondary transfer current in the print mode. Thereafter, the process proceeds to S211 to switch the operating mode from the adjustment mode to the print mode.

It is to be noted that, in the third illustrative embodiment, Yref is set to 0.880.

As described above, the detection line image formed on the intermediate transfer belt 13 is photographed by the pre-transfer imaging unit 8A. Accordingly, the transfer rate Y at the secondary transfer position is calculated, thereby precisely obtaining transfer performance at the secondary transfer position. As a result, an optimal value of the secondary transfer current that prevents white spots in the line image can be reliably set.

Further, in the third illustrative embodiment, control parameters for primary transfer can be simultaneously corrected. In such a case, the trial count, the primary transfer current, and the secondary transfer current are associated with one another in the table, and the primary transfer current and the secondary transfer current are changed for each trial count. The primary transfer current is evaluated based on the toner area before secondary transfer to set an optimal value of the primary transfer current. The secondary transfer current is evaluated based on the transfer rate Y described above and is rarely affected by a variation in the toner area before secondary transfer. As a result, both the primary and secondary transfer currents can be optimally set relative to the line image.

Figure 9:
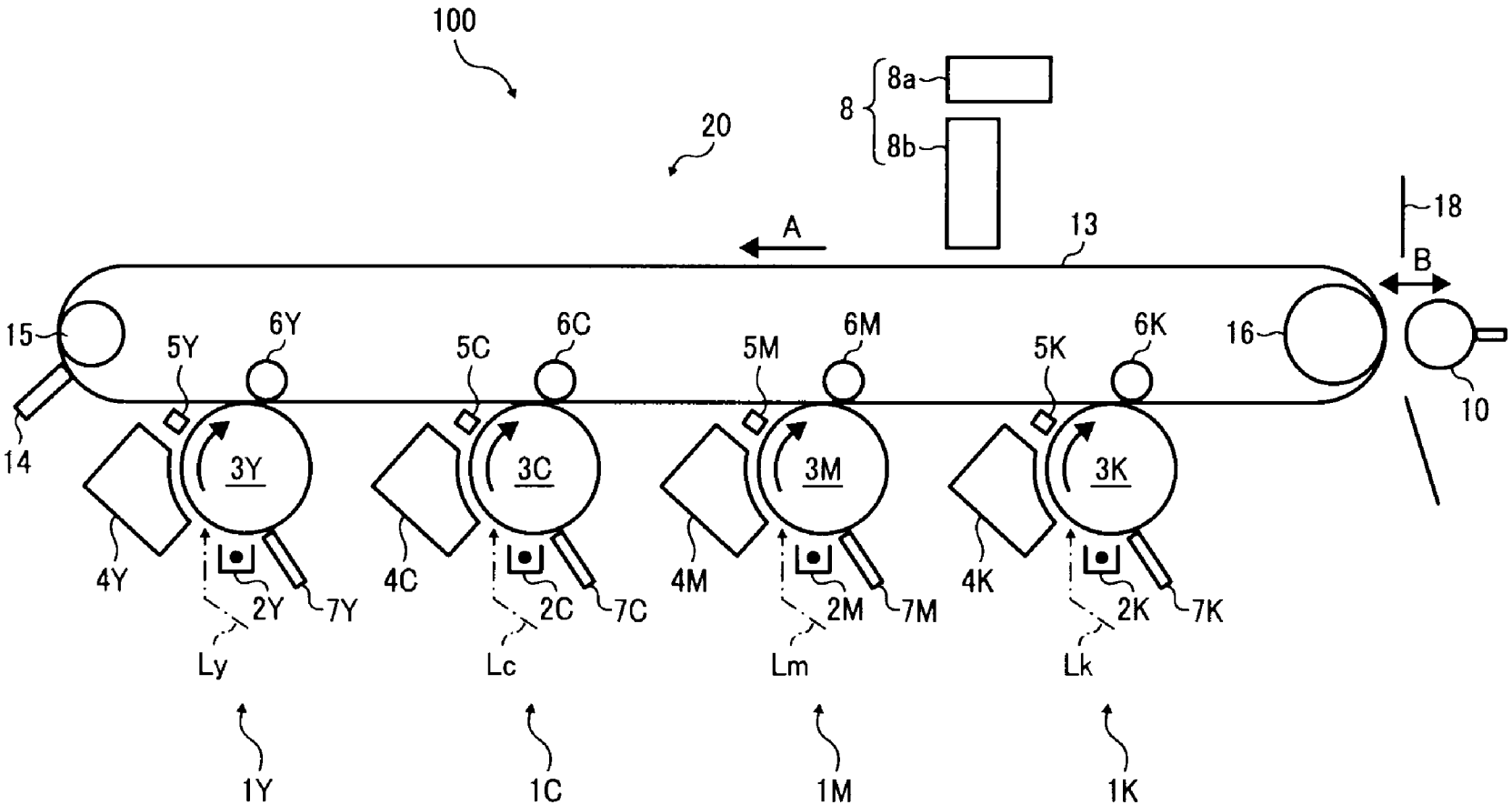
FIG. 9 is a schematic view illustrating a configuration of main components of an image forming apparatus according to a variation example of the third illustrative embodiment.

A description is now given of a variation example of the third illustrative embodiment. FIG. 9 is a schematic view illustrating a configuration of main components of the image forming apparatus 100 according to the variation example of the third illustrative embodiment. As illustrated in FIG. 9, the image forming apparatus 100 further includes a separation unit, not shown, that moves the secondary transfer roller 10 toward and away from the intermediate transfer belt 13 in directions indicated by a double-headed arrow B. In the variation example of the third illustrative embodiment, the imaging unit 8 is provided downstream from the secondary transfer position and upstream from the belt cleaning blade 14 in the direction of rotation of the intermediate transfer belt 13. The imaging unit 8 detects both the detection line image formed on the intermediate transfer belt 13 before secondary transfer and residual toner of the detection line image attached to the intermediate transfer belt 13 after secondary transfer.

Figure 10A:
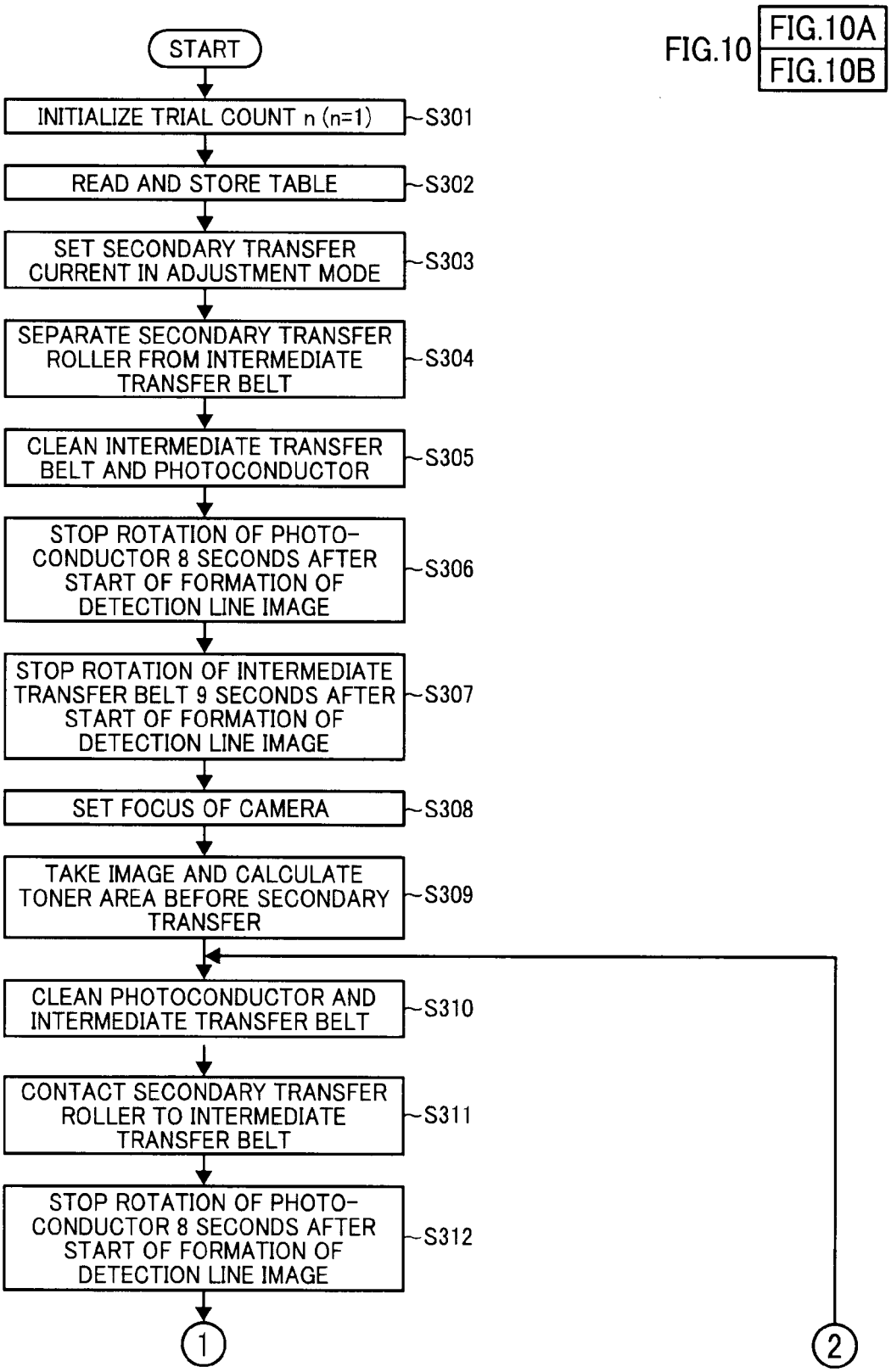
FIG. 10 is a flowchart illustrating steps in a process of correcting a line image according to the variation example of the third illustrative embodiment.
Figure 10B:
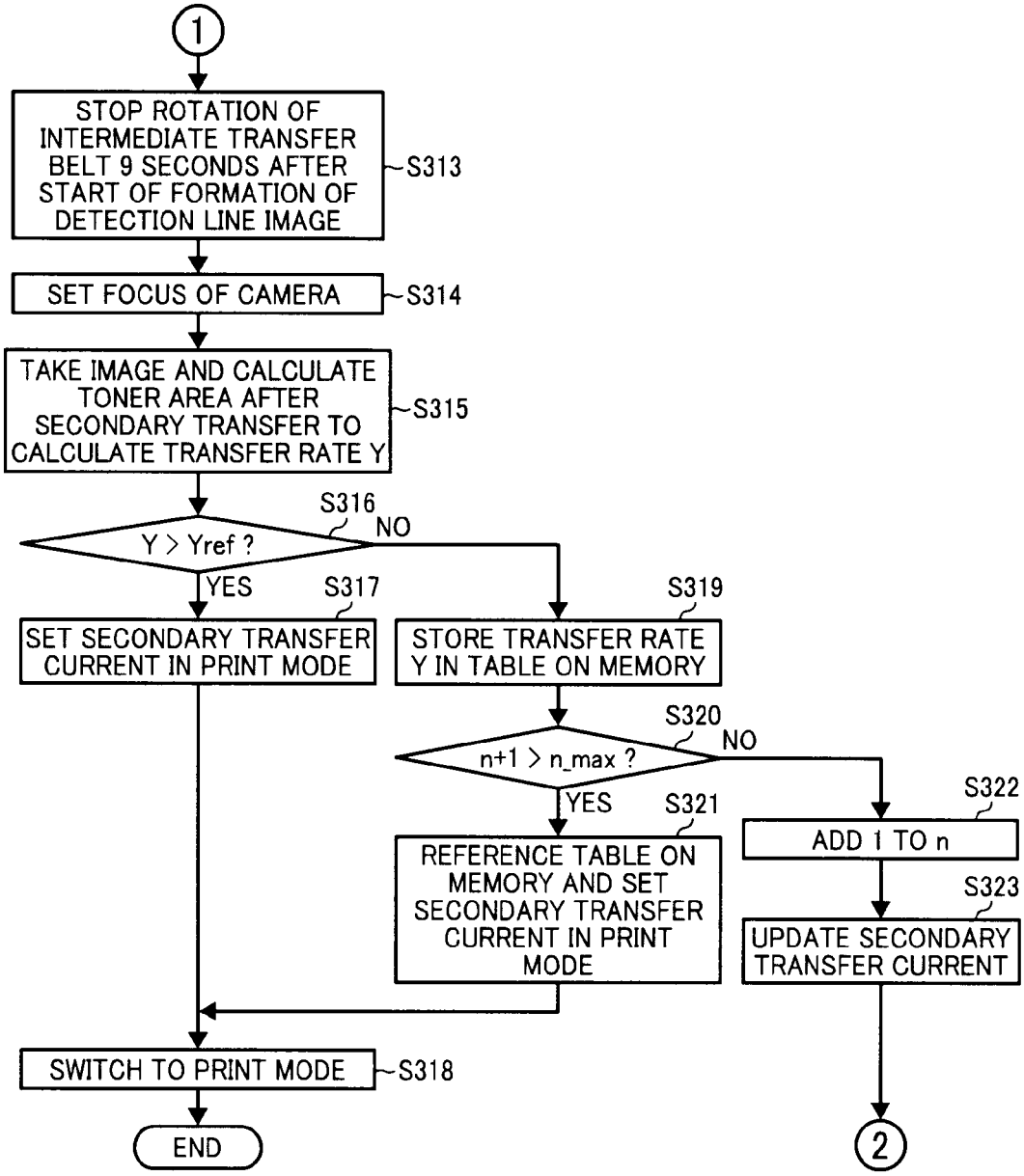

FIG. 10 is a flowchart illustrating steps in a process of correcting a line image according to the variation example of the third illustrative embodiment.

After completion of process control, at S301, 1 is input as a trial count n to initialize the trial count. At S302, the control unit reads out the table like that shown as Table 4 above and stores the table in the RAM. At S303, a secondary transfer current corresponding to n=1 is set as a secondary transfer current in the adjustment mode based on the table. At S304, the secondary transfer roller 10 is separated from the intermediate transfer belt 13. Thereafter, at S305, each of the photoconductor 3K and the intermediate transfer belt 13 is rotated at least one revolution to clean the surfaces of the intermediate transfer belt 13 and the photoconductor 3K. Subsequently, a detection line image is formed at the center of the surface of the photoconductor 3K, and then the detection line image thus formed is primarily transferred onto the intermediate transfer belt 13. At S306, rotation of the photoconductor 3K is stopped 8 seconds after the start of formation of the detection line image. At S307, rotation of the intermediate transfer belt 13 is stopped 9 seconds after the start of formation of the detection line image. At S308, the light source, not shown, of the imaging unit 8 is turned on, and a focus of the camera 8*b* of the imaging unit 8 is set using the autofocusing system. When the focus of the camera 8*b* is set and a completion signal is received, at S309 the camera 8*b* of the imaging unit 8 photographs, at magnification, the detection line image formed on the intermediate transfer belt 13 before the detection line image is secondarily transferred onto a sheet. The image photographed by the imaging unit 8 is directly forwarded to the RAM for processing by the CPU to calculate a toner area before secondary transfer. At S310, the photoconductor 3K and the intermediate transfer belt 13 are rotated to remove residual toner of the detection line image attached to the surface of the photoconductor 3K using the cleaning blade 7K and to clean the intermediate transfer belt 13 using the belt cleaning blade 14. At S311, the secondary transfer roller 10 is caused to contact the intermediate transfer belt 13, and a detection line image is formed at the center of the surface of the photoconductor 3K again. The detection line image thus formed is primarily transferred onto the intermediate transfer belt 13, and then is secondarily transferred onto a sheet from the intermediate transfer belt 13. At S312, rotation of the photoconductor 3K is stopped 8 seconds after the start of formation of the detection line image. At S313, rotation of the intermediate transfer belt 13 is stopped 9 seconds after the start of formation of the detection line image. At S314, the light source, not shown, of the imaging unit 8 is turned on and a focus of the camera 8*b* of the imaging unit 8 is set using the autofocusing system. At S315, the camera 8*b* of the imaging unit 8 photographs the portion of the intermediate transfer belt 13 onto which the detection line image was formed, that is, residual toner of the detection line image attached to the intermediate transfer belt 13 after the detection line image is secondarily transferred onto the sheet. The image photographed by the imaging unit 8 is directly forwarded to the RAM for processing by the CPU to calculate a toner area after secondary transfer. Further, a transfer rate Y is calculated based on the toner areas before and after secondary transfer calculated respectively as described above. At S316, similarly to the third illustrative embodiment, image quality is determined based on the transfer rate Y thus calculated. Specifically, the transfer rate Y is compared to a lower limit Yref to determine image quality. When the transfer rate Y is greater than the lower limit Yref (YES at S316), the process proceeds to S317. At S317, the secondary transfer current set at that time is set as a secondary transfer current in the print mode. At S318, the control unit switches the operating mode from the adjustment mode to the print mode.

By contrast, when the transfer rate Y is not greater than the lower limit Yref (NO at S316), the process proceeds to S319. At S319, it is determined that the line image may include white spots and may have a problem with image quality, and the transfer rate Y calculated as described above is stored in a line of n=1 in the table on memory. At S320, the control unit determines whether or not the trial count n+1 is greater than the maximum trial count (n_max=5) in the table on memory. When the trial count n+1 is not greater than the maximum trial count (n_max=5) in the table on memory (NO at S320), the process proceeds to S322 to add 1 to the trial count n. At S323, the secondary transfer current is updated for the corresponding trial count n based on the table on memory, and the process returns to S310 to perform the subsequent steps for the next trial. It is to be noted that, in the steps on and after the second trial, only the residual toner of the detection line image attached to the intermediate transfer belt 13 after secondary transfer is photographed to calculate the transfer rate Y for the second and subsequent trials using the toner area before secondary transfer obtained in the first trial. Accordingly, time required for adjustment can be shortened. Because the control parameter is the secondary transfer current in the variation example of the third illustrative embodiment, the detection line image formed on the intermediate transfer belt 13 before secondary transfer is not affected by the control parameter to prevent white spots in the line image. Alternatively, the processes from S304 to S309 may be performed in the second and subsequent trials to calculate the toner area before secondary transfer. As a result, the transfer rate Y including a variation in the detection line image before secondary transfer can be calculated, thereby more reliably correcting the line image. In a case in which the control parameter for primary transfer is simultaneously corrected, it is required to photograph the detection line image formed on the intermediate transfer belt 13 before secondary transfer for each condition. In other words, the steps from S304 to S309 are performed in the second and subsequent trials to obtain the toner area before secondary transfer.

When the trial count n+1 is greater than the maximum trial count (n_max=5) (YES at S320), all of the measurement values, that is, the transfer rates Y, in the table on memory are filled. At S321, the control unit references the table on memory to acquire a secondary transfer current corresponding to the maximum transfer rate Y, and sets the secondary transfer current thus acquired as a secondary transfer current in the print mode. Thereafter, the process proceeds to S318 to switch the operating mode from the adjustment mode to the print mode.

A description is now given of a fourth illustrative embodiment of the present invention. A basic configuration of the image forming apparatus 100 according to the fourth illustrative embodiment is the same as that of the image forming apparatus 100 according to the first illustrative embodiment. Therefore, only differences from the image forming apparatus 100 according to the first illustrative embodiment are described in detail below.

Figure 11:
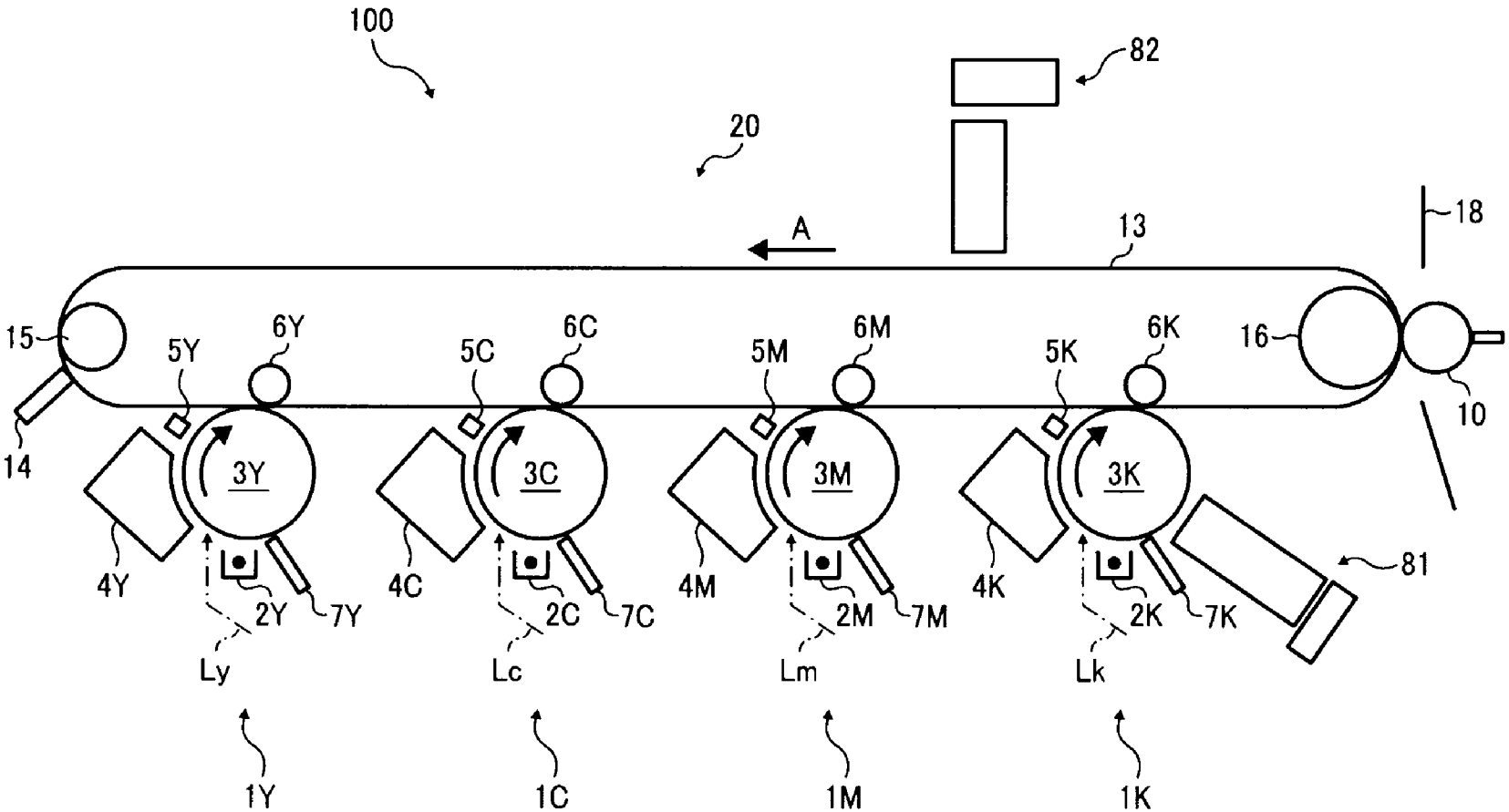
FIG. 11 is a schematic view illustrating a configuration of main components of an image forming apparatus according to a fourth illustrative embodiment.

FIG. 11 is a schematic view illustrating a configuration of main components of the image forming apparatus 100 according to the fourth illustrative embodiment. The image forming apparatus 100 according to the fourth illustrative embodiment includes an imaging unit 81 serving as a first post-transfer imaging unit that photographs residual toner on the surface of the photoconductor 3K after primary transfer, and an imaging unit 82 serving as a second post-transfer imaging unit that photographs residual toner on the intermediate transfer belt 13 after secondary transfer. The imaging unit 81 is provided downstream from the primary transfer position of the toner image of black and upstream from the cleaning blade 7K in the direction of rotation of the photoconductor 3K. The imaging unit 82 is provided downstream from the secondary transfer position and upstream from the belt cleaning blade 14 in the direction of rotation of the intermediate transfer belt 13.

Figure 12A:
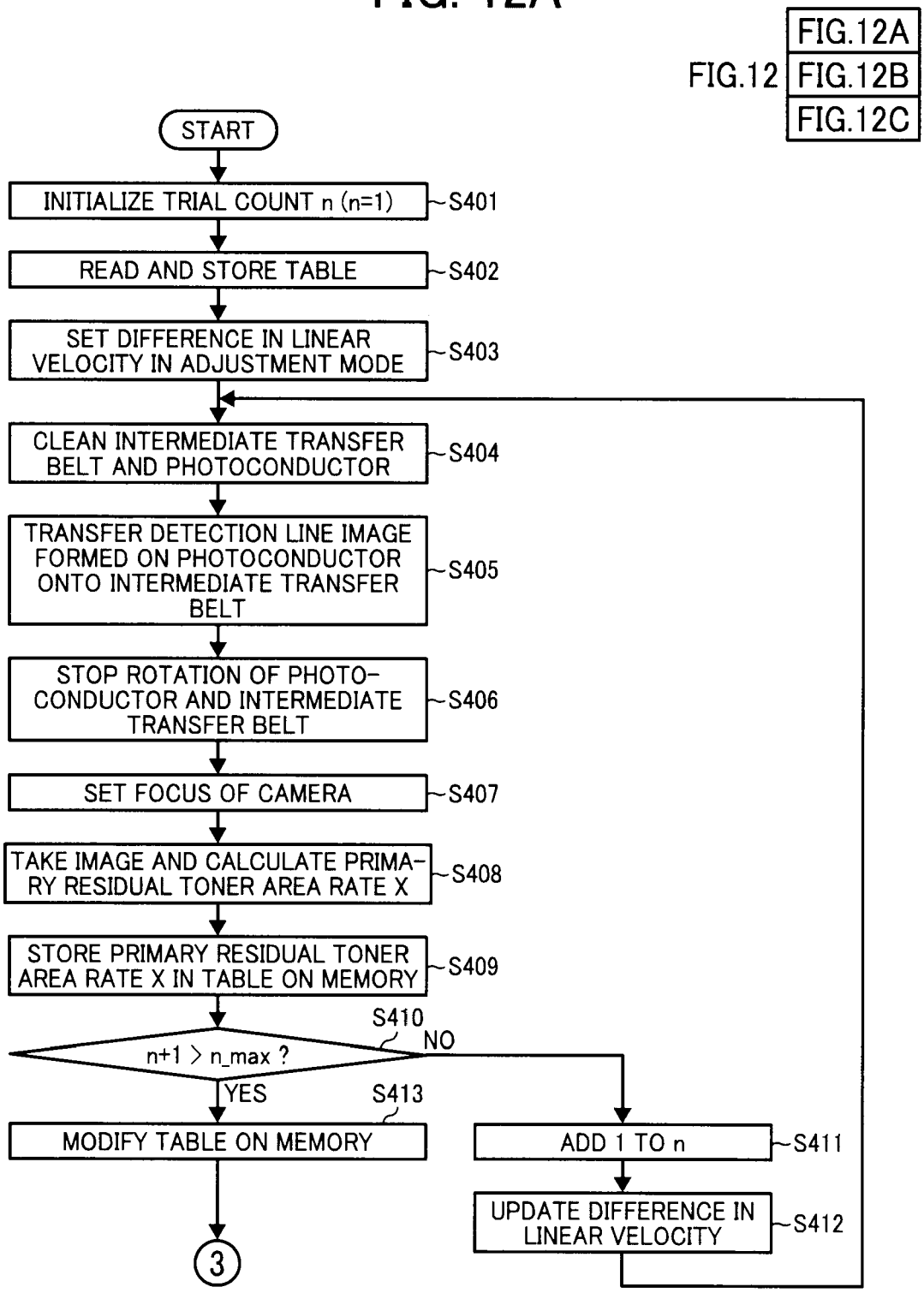
FIG. 12 is a flowchart illustrating steps in a process of correcting a line image according to the fourth illustrative embodiment.
Figure 12B:
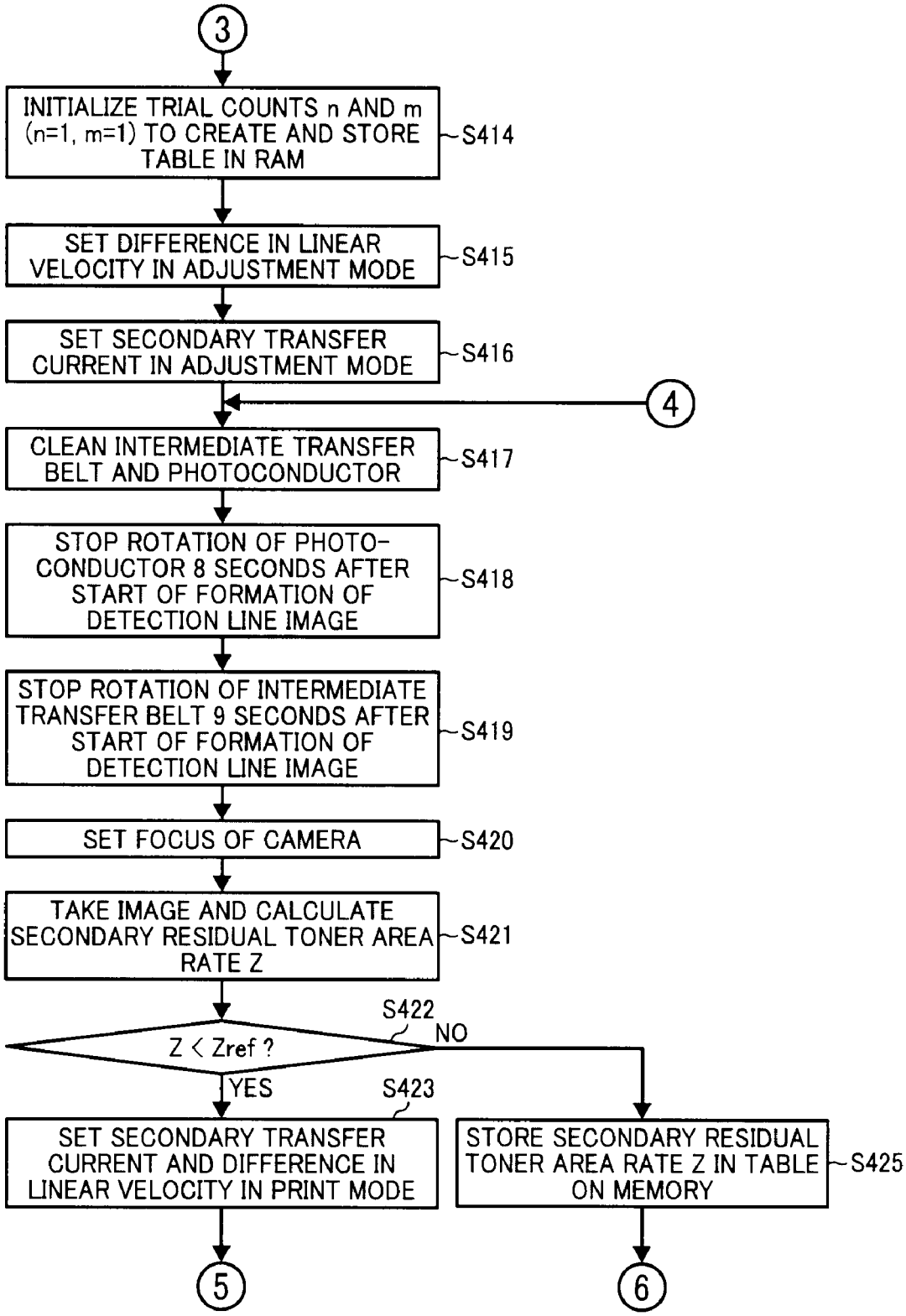
Figure 12C:
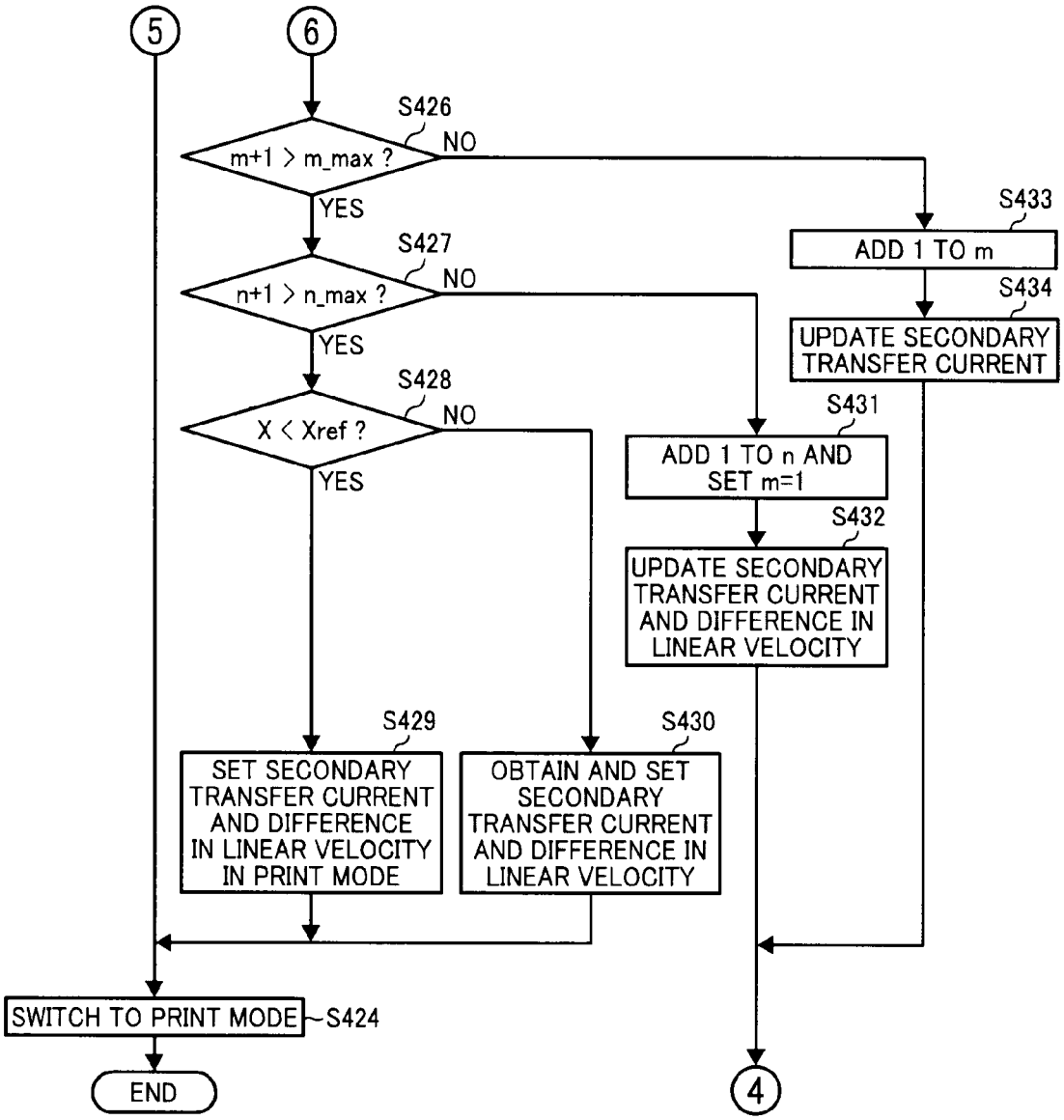

FIG. 12 is a flowchart illustrating steps in a process of correcting a line image performed by the image forming apparatus 100 according to the fourth illustrative embodiment. In the fourth illustrative embodiment, both of the secondary transfer current and the difference in linear velocity between the photoconductor 3K and the intermediate transfer belt 13 are corrected as a control parameter.

Similarly to the first illustrative embodiment, after completion of process control, at S401, 1 is input as a trial count n for the difference in linear velocity to initialize the trial count. At S402, the control unit reads out the table like that shown as Table 1 above and stores the table in the RAM. Next, at S403, the control unit reads out a difference in linear velocity corresponding to n=1 from the table stored in the RAM and sets a difference in linear velocity to 0.30% in the adjustment mode. At S404, each of the photoconductor 3K and the intermediate transfer belt 13 is rotated at least one revolution to clean the surfaces of the intermediate transfer belt 13 and the photoconductor 3K. At S405, a detection line image is formed at the center of the surface of the photoconductor 3K in the main scanning direction and is primarily transferred onto the intermediate transfer belt 13. At S406, rotation of the photoconductor 3K and the intermediate transfer belt 13 is stopped 2 seconds after the start of formation of the detection line image. At S407, a light source, not shown, of the imaging unit 81 is turned on, and a focus of a camera of the imaging unit 81 is set using an autofocusing system. At S408, the imaging unit 81 photographs residual toner of the detection line image attached to the surface of the photoconductor 3K after primary transfer, and the image thus photographed is processed by the CPU to calculate a primary residual toner area rate X. At S409, the primary residual toner area rate X thus calculated is stored in the table on memory. The primary residual toner area rates X for each of the differences in linear velocity stored in the table on memory are acquired as described above. When the primary residual toner area rates X for all of the differences in linear velocity stored in the table on memory are acquired (YES at S410), the process proceed to S413. At S413, the primary residual toner area rates X thus acquired are ordered from the smallest to the largest in the table on memory and the trial counts n are renumbered accordingly. Specifically, Table 2 shown above is modified like that shown as Table 5 below.

TABLE 5

| Trial Count n | Difference in Linear Velocity | Measurement Value X |
|---|---|---|
| 1 | 0.35% | 0.052 |
| 2 | 0.30% | 0.078 |
| 3 | 0.20% | 0.081 |

TABLE 5-continued

| Trial Count n | Difference in Linear Velocity | Measurement Value X |
|---|---|---|
| 4 | 0.25% | 0.092 |
| 5 | 0.15% | 0.099 |

Thereafter, at S414, 1 is input as both the trial count n for the difference in linear velocity and a trial count m for a secondary transfer current to initialize the trial counts. Table 6 shown below, in which a relation between a difference in linear velocity and a secondary transfer current is stored, is created using the Tables 4 and 5 above, and the table thus created is stored in the RAM. It is to be noted that, alternatively, a table like that shown as Table 6 below may be created in advance and the primary residual toner area rates X may be ordered from the smallest to the largest in the table after the primary residual toner area rates X for all of the differences in linear velocity are acquired in the table.

TABLE 6

| n | m | Difference in Linear Velocity (%) | Secondary Transfer Current (μA) | X | Z |
|---|---|---|---|---|---|
| 1 | 1 | 0.35% | −42 | 0.052 | |
| | 2 | | −47 | | |
| | 3 | | −37 | | |
| | 4 | | −50 | | |
| | 5 | | −35 | | |
| 2 | 1 | 0.20% | −42 | 0.078 | |
| | 2 | | −47 | | |
| | 3 | | −37 | | |
| | 4 | | −50 | | |
| | 5 | | −35 | | |
| 3 | 1 | 0.25% | −42 | 0.081 | |
| | 2 | | −47 | | |
| | 3 | | −37 | | |
| | 4 | | −50 | | |
| | 5 | | −35 | | |
| 4 | 1 | 0.30% | −42 | 0.092 | |
| | 2 | | −47 | | |
| | 3 | | −37 | | |
| | 4 | | −50 | | |
| | 5 | | −35 | | |
| 5 | 1 | 0.15% | −42 | 0.099 | |
| | 2 | | −47 | | |
| | 3 | | −37 | | |
| | 4 | | −50 | | |
| | 5 | | −35 | | |

At S415, the difference in linear velocity between the photoconductor 3K and the intermediate transfer belt 13 that corresponds to the trial count n=1, that is, 0.35%, is acquired from the table shown as Table 6 above and stored in the RAM, and is set as a difference in linear velocity in the adjustment mode. At S416, the secondary transfer current that corresponds to the trial count m=1, that is, −42 μA, is acquired from the table stored in the RAM and is set as a secondary transfer current in the adjustment mode. Thereafter, similarly to the second illustrative embodiment, at S417 each of the photoconductor 3K and the intermediate transfer belt 13 is rotated at least one revolution to clean the surfaces of the intermediate transfer belt 13 and the photoconductor 3K. Subsequently, a detection line image is formed at the center of the surface of the photoconductor 3K in the main scanning direction again. The detection line image thus formed is primarily transferred onto the intermediate transfer belt 13, and then is secondarily transferred onto a sheet from the intermediate transfer belt 13. At S418, rotation of the photoconductor 3K is stopped 8 seconds after the start of formation of the detection line image. At S419, rotation of the intermediate transfer belt 13 is stopped 9 seconds after the start of formation of the detection line image. At S420, a light source, not shown, of the imaging unit 82 is turned on, and a focus of a camera of the imaging unit 82 is set using an autofocusing system. When the focus of the camera of the imaging unit 82 is set and a completion signal is received, at S421 the camera of the imaging unit 82 photographs, at magnification, residual toner of the detection line image attached to the intermediate transfer belt 13 after secondary transfer. The image thus photographed by the camera of the imaging unit 82 is directly forwarded to the RAM for processing by the CPU to calculate a secondary residual toner area rate Z.

At S422, image quality is determined based on the secondary residual toner area rate Z thus calculated. Specifically, the secondary residual toner area rate Z is compared to an upper limit Zref to determine image quality. When the secondary residual toner area rate Z is smaller than the upper limit Zref (YES at S422), the process proceeds to S423. At S423, the secondary transfer current and the difference in linear velocity respectively set at that time are set as a secondary transfer current and a difference in linear velocity in the print mode. At S424, the control unit switches the operating mode from the adjustment mode to the print mode.

By contrast, when the secondary residual toner area rate Z is not smaller than the upper limit Zref (NO at S422), the process proceeds to S425. At S425, the secondary residual toner area rate Z calculated as described above is stored in a line of n=1 and m=1 in the table on memory. At S426, the control unit determines whether or not the trial count m+1 is greater than the maximum trial count (m_max=5) in the table on memory. When the trial count m+1 is not greater than the maximum trial count (m_max=5) in the table on memory (NO at S426), the process proceeds to S433 to add 1 to the trial count m. At S434, the secondary transfer current is updated for the corresponding trial count m based on the table on memory, and the process returns to S417 to perform the subsequent steps for the next trial. In the fourth illustrative embodiment, Zref is set to 0.045.

When the trial count m+1 is greater than the maximum trial count (m_max=5) in the table on memory, that is, when the secondary residual toner area rate Z is always greater than the upper limit Zref for the trial count m of from 1 to 5 (YES at S426), the process proceeds to S427 to determine whether or not the trial count n+1, that is, 2 for example, is greater than the maximum trial count (n_max=5) in the table on memory. When the trial count n+1 is not greater than the maximum trial count (n_max=5) in the table on memory (NO at S427), the process proceeds to S431 to add 1 to the trial count n and set the trial count n to 2, and to initialize the trial count m (m=1). At S432, the difference in linear velocity is updated for the corresponding trial count n, that is, 2, and the secondary transfer current is updated for the corresponding trial count m, that is, 1, based on the table on memory. The process returns to S417 to perform the subsequent steps for the next trial.

When the trial count n+1 is greater than the maximum trial count (n_max=5) in the table on memory (YES at S427), that is, when the secondary residual toner area rate Z is not smaller than the upper limit Zref for all of the differences in linear velocity and the secondary transfer currents in the table on memory, the process proceeds to S428 to determine whether or not a condition that satisfies a relation of X<Xref is present in the table like that shown as Table 6 above. When the condition that satisfies the relation of X<Xref is present in the table (YES at S428), the process proceeds to S429 so that a combination of the secondary transfer current and the difference in linear velocity corresponding to the minimum secondary residual toner area rate Z is acquired and is set as a difference in linear velocity and a secondary transfer current in the print mode. In the fourth illustrative embodiment, Xref is set to 0.50.

By contrast, when the condition that satisfies the relation of X<Xref is not present in the table (NO at S428), the process proceeds to S430 to set a secondary transfer current and a difference in linear velocity in the print mode as described below.

A description is now given of setting of a secondary transfer current and a difference in linear velocity in the print mode when the condition that satisfies the relations of Z<Zref and X<Xref is not present in the table (NO at S428).

On a plane having a horizontal axis representing the primary residual toner area rate X and a vertical axis representing the secondary residual toner area rate Z, a point of coordinates (Xref, Zref) is indicated as a point P. Euclidean distances between the point P and each of coordinates (X, Z) for respective conditions are obtained, and the minimum Euclidean distance among these is considered an optimal combination.

In the above description, conditions that satisfy the relations of Z<Zref and X<Xref are searched preferentially. When such conditions are not found, conditions in which an amount of residual toner on the intermediate transfer belt 13 is lower than a reference value have priority. However, control is not limited thereto. For example, first, the secondary residual toner area rates Z corresponding to all of the secondary transfer currents may be obtained and ordered from the smallest to the largest. Subsequently, the primary residual toner area rates X may be evaluated. When all of the primary residual toner area rates X are greater than the upper limit Xref, conditions in which the secondary residual toner area rate Z is smaller than the upper limit Zref may be searched. In other words, when the conditions that satisfy the relations of Z<Zref and X<Xref are not found, conditions in which an amount of residual toner on the surface of the photoconductor 3K is smaller than the reference value have priority. Further alternatively, all conditions may be evaluated and a condition having the minimum Euclidean distance between the point P and a point of corresponding coordinates (X, Z) may then be set as an optimal combination.

In the fourth illustrative embodiment, both the difference in linear velocity serving as a control parameter for primary transfer and the secondary transfer current serving as a control parameter for secondary transfer are corrected as described above. Accordingly, white spots in a line image can be more reliably prevented.

A description is now given of a fifth illustrative embodiment of the present invention. A basic configuration of the image forming apparatus 100 according to the fifth illustrative embodiment is the same as that of the image forming apparatus 100 according to the fourth illustrative embodiment, and therefore, a description thereof is omitted.

In the fifth illustrative embodiment, in addition to a detection line image, a detection solid image is formed as an image for detection during correction of a line image. Accordingly, residual toner of the detection line image and the detection solid image each photographed by the imaging units 81 and 82 are used for correcting the line image. Further, image processing performed in the fifth illustrative embodiment is different from that performed in the first to fourth illustrative embodiments.

Figure 13A:
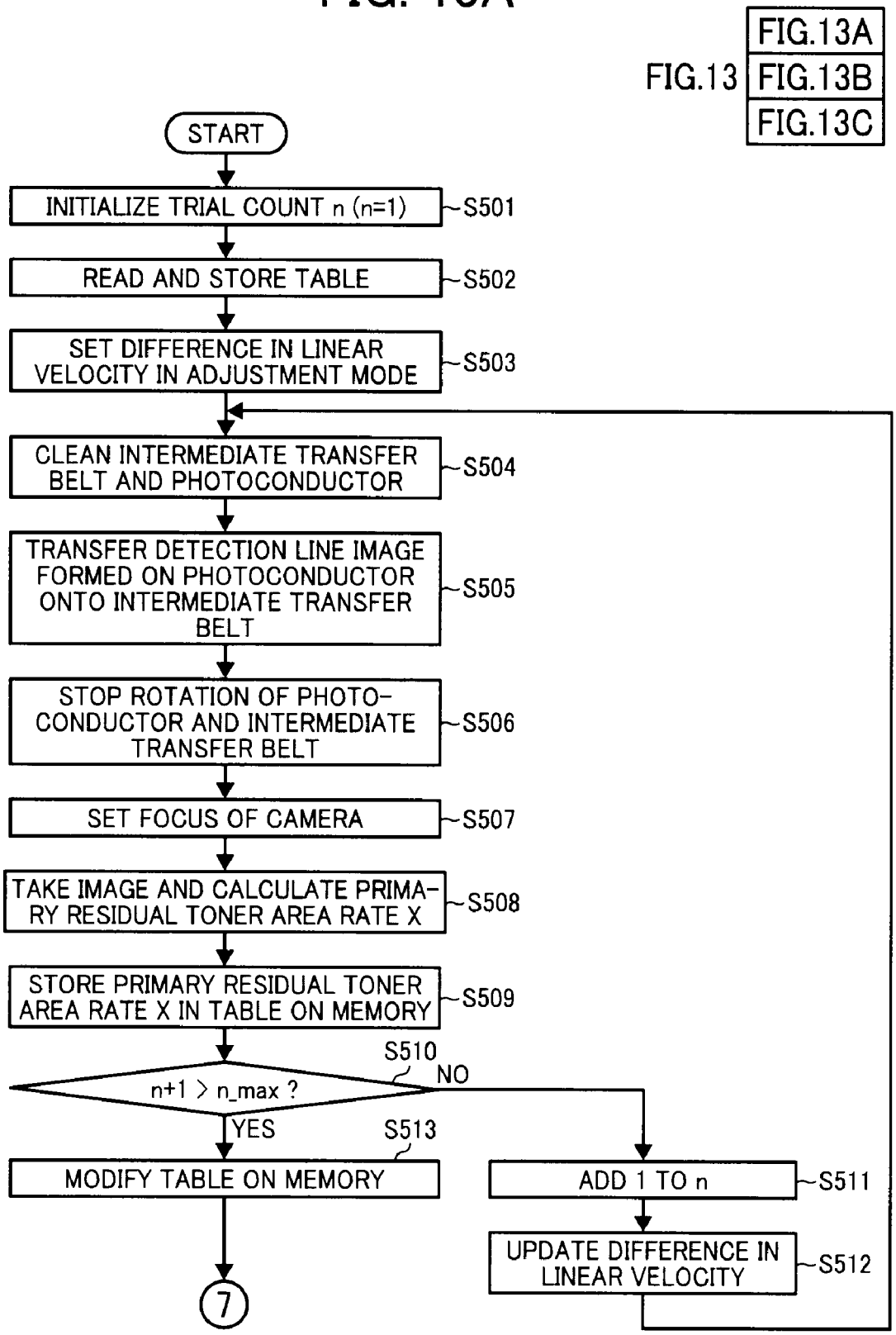
FIG. 13 is a flowchart illustrating steps in a process of correcting a line image according to a fifth illustrative embodiment.
Figure 13B:
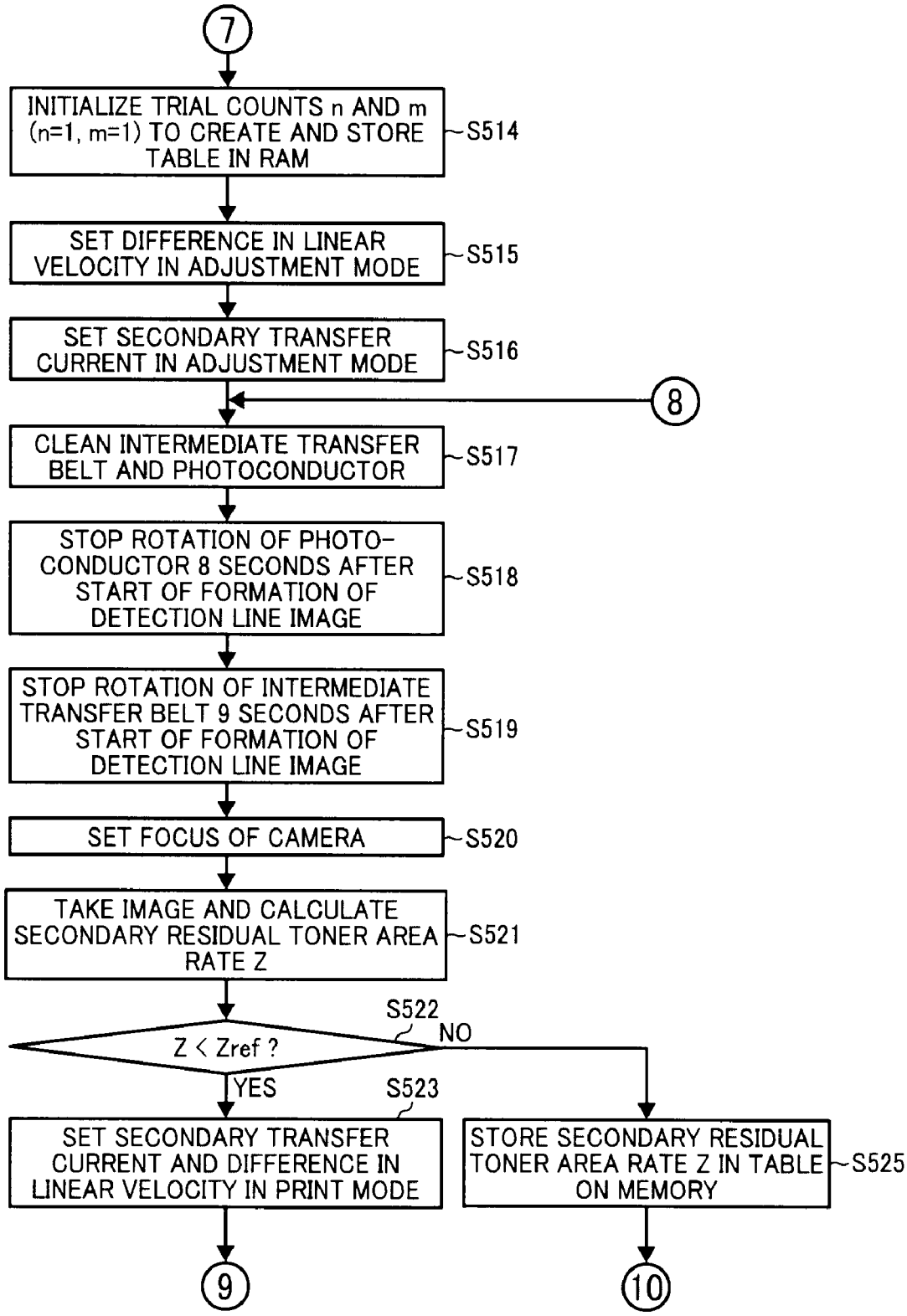
Figure 13C:
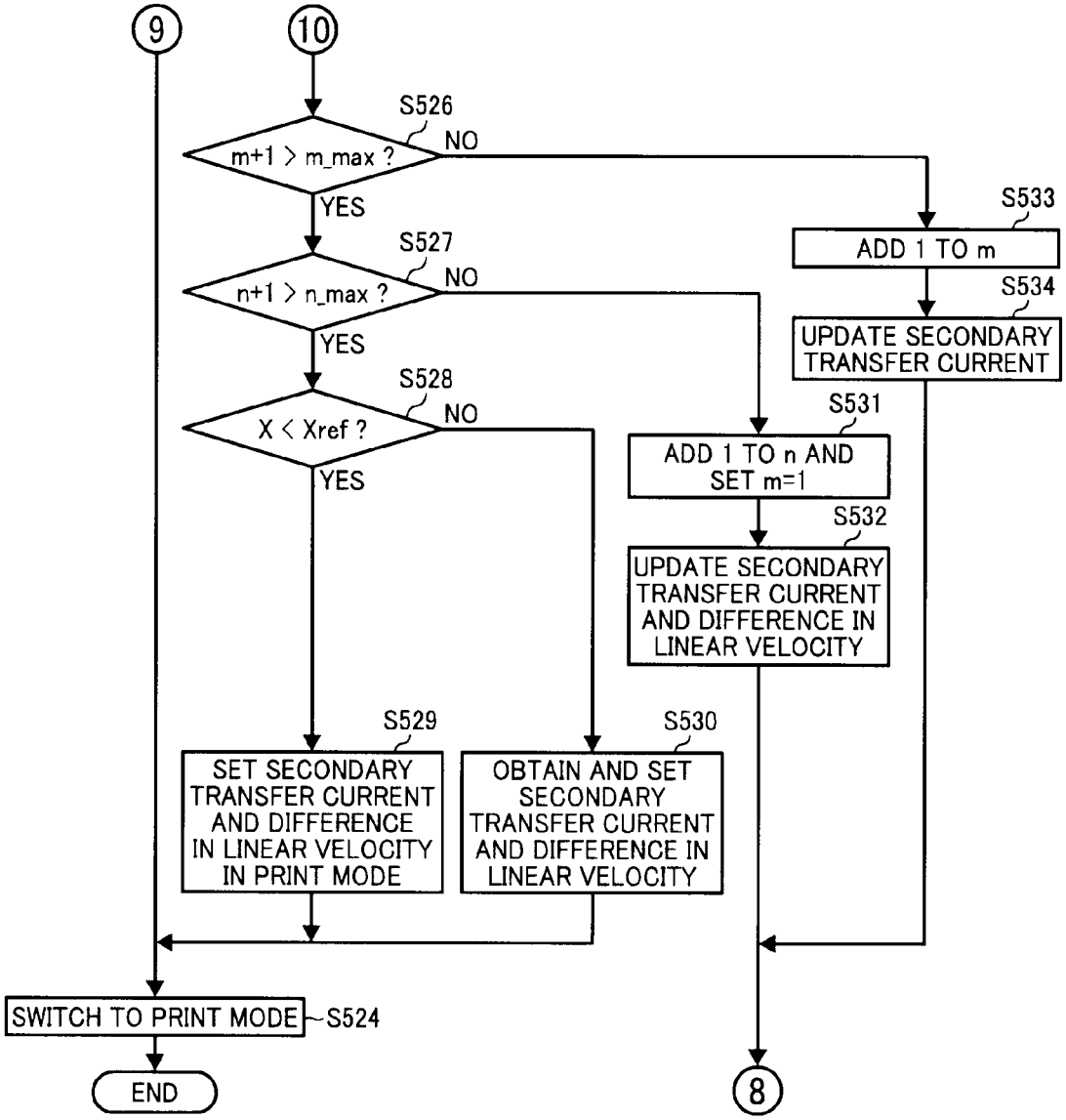

FIG. 13 is a flowchart illustrating steps in a process of correcting a line image performed by the image forming apparatus 100 according to the fifth illustrative embodiment.

The steps in a process of correcting a line image according to the fifth illustrative embodiments are substantially the same as those performed in the fourth illustrative embodiment. Therefore, only differences from the fourth illustrative embodiment are described in detail below.

In the fifth illustrative embodiment, first, a detection line image is formed to photograph residual toner of the detection line image attached to the photoconductor 3K after primary transfer using the imaging unit 81, and then a detection solid image is formed to photograph residual toner of the detection solid image attached to the photoconductor 3K after primary transfer using the imaging unit 81. In other words, steps from S504 to S508 are performed twice, the first time for the detection line image, and the second time for the detection solid image. Thereafter, image processing to be described below is performed to calculate the maximum primary residual toner area rate Xmax.

Similarly to the first illustrative embodiment, the images photographed by the imaging unit 81 are divided into pixels to digitize the images into a toner portion and a non-toner portion. Subsequently, the toner portion is clustered.

Figure 14:
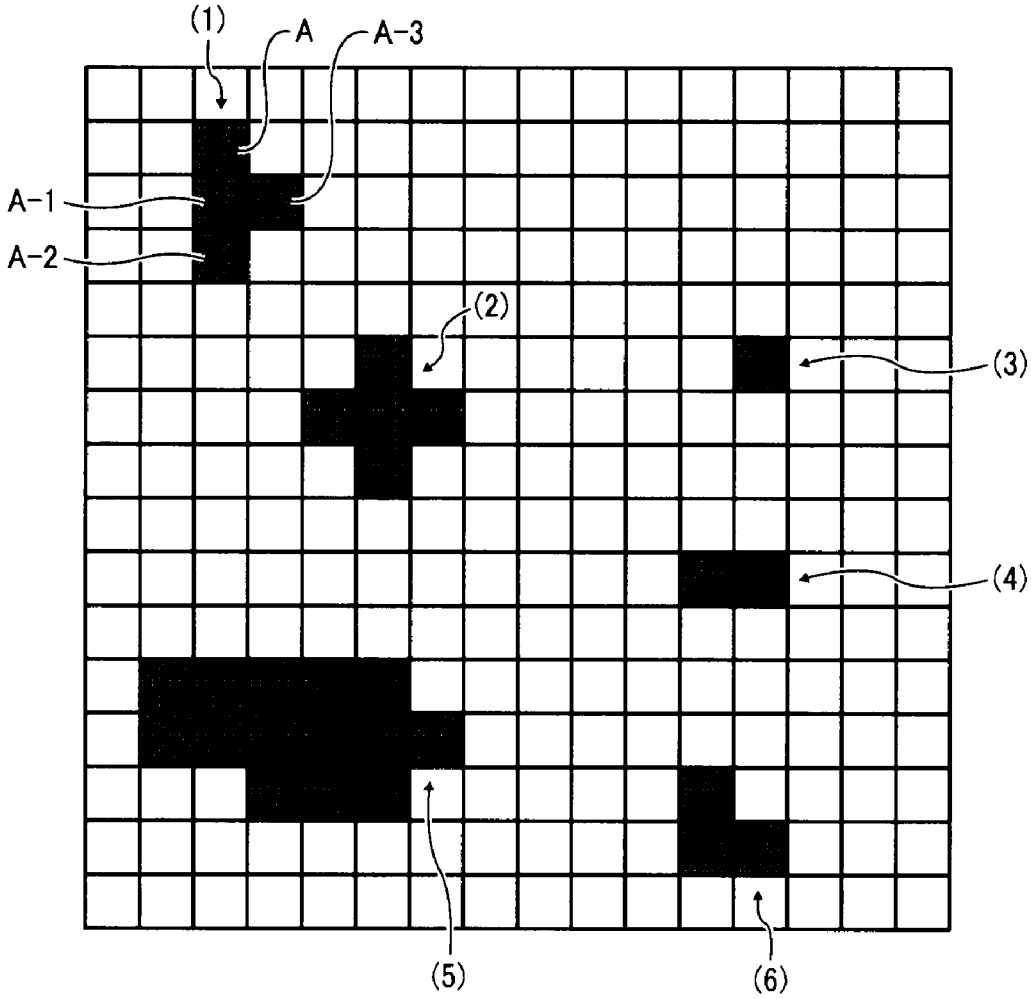
FIG. 14 is a view illustrating an example of a photographed image after digitization.

A description is now given of clustering of the toner portion with reference to FIG. 14. FIG. 14 is a view illustrating an example of a photographed image after digitization. In FIG. 14, toner portions are indicated by shaded cells. First, it is determined whether or not toner portions are present adjacent to a toner portion A in FIG. 14. The toner portions adjacent to the toner portion A may be determined using either the Von Neumann neighborhood or the Moore neighborhood. Specifically, four cells adjacent to the toner portion A, that is, cells above, below, right, and left of the toner portion A, or eight cells adjacent to the toner portion A, that is, cells above, below, right, left, and diagonally above and below of the toner portion A are determined as the toner portions adjacent to the toner portion A. Determination of the toner portions adjacent to the toner portion A is not limited to the above-described methods. Here, the four cells above, below, right, and left of the toner portion A are determined as the toner portions adjacent to the toner portion A based on the Von Neumann neighborhood. As shown in FIG. 14, a toner portion A-1 is adjacent to the toner portion A. Subsequently, it is determined whether or not toner portions adjacent to the toner portion A-1 are present except for the toner portion A. When the toner portions adjacent to the toner portion A-1 such as toner portions A-2 and A-3 are present, then it is determined whether or not toner portions adjacent to the toner portions A-2 and A-3 are present. The above-described determination is further performed to obtain a cluster including multiple toner portions. In the example shown in FIG. 14, 6 clusters indicated by (1) to (6) are found by performing the above-described clustering processes. Alternatively, the cluster may be defined by another method for characterizing distribution of toner on a plane using network and so forth. Although a boundary portion of the image is treated as a fixed boundary to perform clustering in the above description, alternatively, the boundary portion of the image may be treated as a calculated periodic boundary to perform clustering.

After clustering is performed as described above, the control unit obtains an area of each cluster to specify the cluster having the maximum area (hereinafter referred to as a maximum cluster area), that is, a cluster (5) in FIG. 14. The maximum cluster areas for each of the detection line image and the detection solid image are obtained as described above. Thereafter, the maximum primary residual toner area rate Xmax is calculated based on the maximum cluster area obtained by the photographed image of residual toner of the detection line image (hereinafter referred to as the maximum line cluster area) and the maximum cluster area obtained from the photographed image of residual toner of the detection solid image (hereinafter referred to as the maximum solid cluster area) using an equation of Xmax=(Maximum Solid Cluster Area)+(Maximum Line Cluster Area).

The reason for quantifying residual toner based on the clusters is described below.

Figure 15:
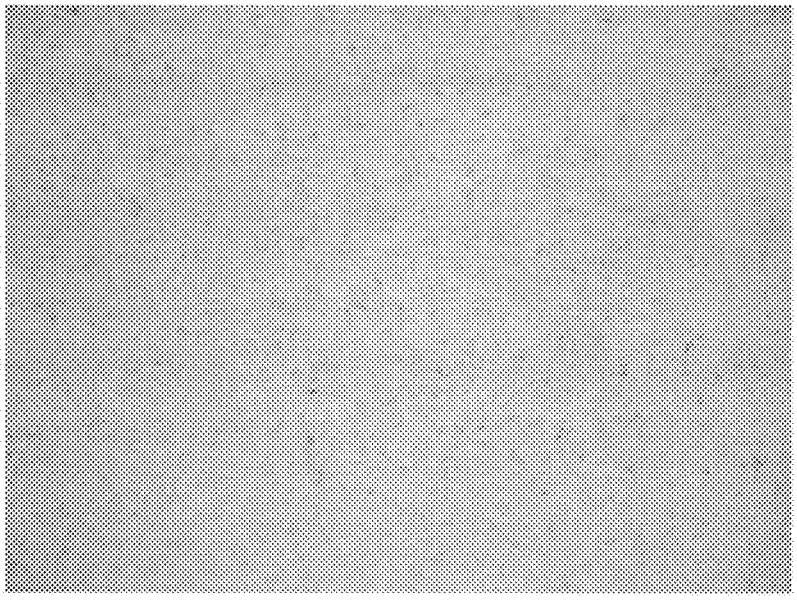
FIG. 15 is a view illustrating an image of a surface of a photoconductor after primary transfer photographed by an imaging unit when a resultant image formed on a sheet has less uneven image density.
Figure 16:
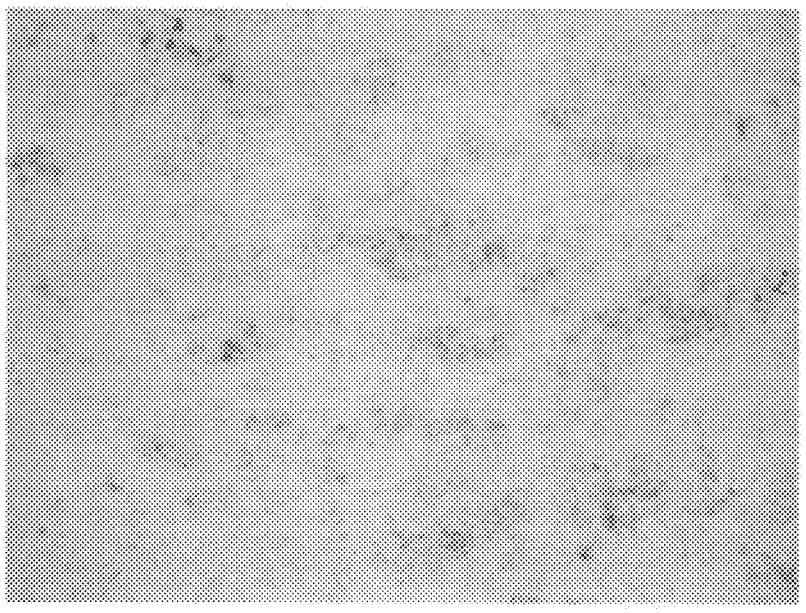
FIG. 16 is a view illustrating an image of a surface of a photoconductor after primary transfer photographed by an imaging unit when a resultant image formed on a sheet has prominent uneven image density.

FIG. 15 is a view illustrating an image of the surface of the photoconductor 3K after primary transfer photographed by the imaging unit 81 when a resultant image formed on a sheet has less uneven image density. FIG. 16 is a view illustrating an image of the surface of the photoconductor 3K after primary transfer photographed by the imaging unit 81 when a resultant image formed on a sheet has prominent uneven image density. In FIGS. 15 and 16, black spots indicate residual toner.

In general, uneven residual toner on the surfaces of the photoconductors 3 causes uneven image density and white spots in a resultant line image. By contrast, although a resultant image may be light overall, uniform transfer of even a small amount of toner from the surfaces of the photoconductors 3 onto the intermediate transfer belt 13 does not cause uneven image density and white spots. In such a case, thickness of the resultant image can be easily adjusted by increasing an amount of toner attached to the surfaces of the photoconductors 3 when toner images are formed on the surfaces of the photoconductors 3. Therefore, it is preferable that conditions that do not cause uneven residual toner on the surfaces of the photoconductors 3 be found in order to prevent white spots and uneven image density in the line image.

For example, white spots in line images formed by an image forming apparatus in which states of residual toner on surfaces of photoconductors are different in each image formation sequence as shown in FIGS. 15 and 16 were visually evaluated into 5 levels from Levels 1 to 5. The lower levels such as Levels 1 and 2 indicate poorer evaluation results. Level 4 and higher are deemed acceptable for evaluation purpose. An image formed under the condition shown in FIG. 15 was evaluated as Level 5, and an image formed under the condition shown in FIG. 16 was evaluated as Level 3, resulting in a large difference in image quality between the images. When the photographed images respectively shown in FIGS. 15 and 16 are processed to obtain the residual toner area rate X for each photographed image using an equation of X=(Residual Toner Area)/(Total Area of Photographed Image), the residual toner area rate X of the photographed image shown in FIG. 15 is about 0.04, and that in FIG. 16 is 0.13. In other words, the residual toner area rate X of the photographed image shown in FIG. 16 is about 3.25 times as large as that of FIG. 15.

When the photographed images shown in FIGS. 15 and 16 are processed and are divided into clusters to obtain the maximum cluster area, the maximum cluster area of the photographed image shown in FIG. 15 was $6.2\times10^{-4}$, and that of FIG. 16 was $4.9\times10^{-3}$. In other words, the maximum cluster area of the photographed image shown in FIG. 16 is about 7.9 times as large as that of FIG. 15. Accordingly, sensitivity can be enhanced by dividing the photographed image into clusters and quantifying based on the clusters, thereby more accurately correcting image forming conditions.

The maximum primary residual toner area rate Xmax is calculated for all of the differences in linear velocity in the table, and a difference in linear velocity corresponding to n=1 and a secondary transfer current corresponding to m=1 are set in the same manner as the fourth illustrative embodiment to form detection images. Specifically, a detection line image is formed to photograph residual toner of the detection line image attached to the intermediate transfer belt 13 after secondary transfer using the imaging unit 82, and then a detection solid image is formed to photograph residual toner of the detection solid image attached to the intermediate transfer belt 13 after secondary transfer using the imaging unit 82. In other words, steps from S517 to S521 are performed twice, the first time for the detection line image, and the second time for the detection solid image. Thereafter, the photographed images are digitized and clustering is performed as described above to calculate the maximum secondary residual toner area rate Zmax using an equation of Zmax=(Maximum Solid Cluster Area)+(Maximum Line Cluster Area).

Thereafter, determination is performed in the same manner as the fourth illustrative embodiment to set the difference in linear velocity and the secondary transfer current. It is to be noted that Xref is set to $5.0\times10^{-3}$ and Zref is set to $2.0\times10^{-3}$ in the fifth illustrative embodiment. The values of Xref and Zref are not particularly limited thereto, and may be appropriately set depending on characteristics of apparatuses.

Although Xmax and Zmax are obtained by adding the maximum solid cluster area and the maximum line cluster area as described above, the maximum solid cluster area and the maximum line cluster area may be multiplied by an appropriate factor and then be added to each other to obtain Xmax and Zmax, or the maximum solid cluster area may be multiplied by the maximum line cluster area. Further alternatively, Xmax and Zmax may be quantified using another calculation method.

As described above, in the fifth illustrative embodiment, image forming conditions are adjusted based on the residual toner of each of the solid image and the line image. Accordingly, both the solid and line images can have higher image quality. In addition, the residual toner is photographed to be divided into clusters, and image forming conditions are adjusted based on the clusters thus divided. Accordingly, detection sensitivity is enhanced, and an optimal image forming condition that prevents white spots in the line image can be set. Further, the optimal image forming condition that prevents uneven image density of the solid image can be set.

A description is now given of a test performed by inventors of the present invention.

In the test, images were formed using a related-art image forming apparatus and the image forming apparatus 100 according to the first to fifth illustrative embodiments under two different environmental conditions, that is, a higher temperature and humidity condition and a lower temperature and humidity condition. In the higher temperature and humidity condition, a temperature was set to 27° C. and a humidity was set to 80%. In the lower temperature and humidity condition, a temperature was set to 10° C. and a humidity was set to 15%. The images formed by the respective image forming apparatuses under the two different environmental conditions were evaluated. The related-art image forming apparatus includes a temperature and humidity detector, and image forming conditions including a transfer current are adjusted based on a result detected by the temperature and humidity detector. Further, process control is performed by the related-art image forming apparatus at the same timing as the image forming apparatus 100 according to the first to fifth illustrative embodiments to measure a toner density of a solid image using a detector to control an image forming condition, that is, a charging voltage. Developer used in the test for visualizing a latent image was deteriorated by being agitated for 60 minutes in a developing device to facilitate evaluation. The images formed in the test include a solid patch, a line having a width of 5 dots, and a Chinese Character. The levels of white spots in the images were then sorted into 5 ranks from Ranks 1 to 5.

Specifically, Rank 5 indicates that no white spots are found in the image. Rank 4 indicates that, although a slight amount of white spots are found, most of them are not visually confirmed. Rank 3 indicates that white spots that can be visually confirmed are found in the image. Rank 2 indicates that white spots are prominent in the image. Rank 1 indicates that some portions in the image are not clear due to white spots.

TABLE 7

| | Environment | | | | | |
|---|---|---|---|---|---|---|
| | 10° C./15% | | | 27° C./80% | | |
| | Pattern | | | | | |
| | Solid Image | Line Image | Chinese Chara. | Solid Image | Line Image | Chinese Chara. |
| Related Art | 3 | 4 | 3 | 3 | 2 | 2 |
| 1st Embo. | 3 | 4 | 3 | 3 | 4 | 3 |
| 2nd Embo. | 4 | 4 | 3 | 3 | 3 | 3 |
| 3rd Embo. | 4 | 4 | 3 | 3 | 4 | 3 |
| 4th Embo. | 4 | 5 | 4 | 4 | 5 | 4 |
| 5th Embo. | 5 | 5 | 4 | 4 | 5 | 4 |

As shown in Table 7 above, white spots in the line image and in the Chinese character formed by the image forming apparatus 100 according to the first to fifth illustrative embodiments were reduced in the higher temperature and humidity condition. In the image forming apparatus 100 according to the fourth and fifth illustrative embodiments in which the difference in linear velocity and the secondary transfer current were adjusted, white spots were reliably prevented. In the image forming apparatus 100 according to the fifth illustrative embodiment in which the difference in linear velocity and the secondary transfer current were adjusted based also on the residual toner of the solid image, white spots in the solid image were further prevented under the lower temperature and humidity condition compared to the image forming apparatus 100 according to the fourth illustrative embodiment.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a latent image carrier;

a developing device to supply toner to the latent image carrier and develop a latent image formed on a surface of the latent image carrier with the toner to form a toner image;

a transfer device to either directly transfer the toner image formed on the surface of the latent image carrier onto a recording medium, or to primarily transfer the toner image from the latent image carrier onto an intermediate transfer body and then secondarily transfer the toner image from the intermediate transfer body onto a recording medium;

a post-transfer imaging unit to photograph, at magnification, the surface of the latent image carrier after transfer of the toner image from the latent image carrier onto either the recording medium or the intermediate transfer body, or a surface of the intermediate transfer body after transfer of the toner image from the intermediate transfer body onto the recording medium; and a control unit to control one or more image forming conditions based on a quantified value for residual toner of a detection pattern obtained by forming the detection pattern and photographing a portion of the surface of the latent image carrier or the intermediate transfer body on which the detection pattern is formed after transfer of the detection pattern from the latent image carrier onto the recording medium or the intermediate transfer body or after transfer of the detection pattern from the intermediate transfer body onto the recording medium using the post-transfer imaging unit, the quantified value representing the amount of residual toner of the detection pattern attached to either the surface of the latent image carrier or the intermediate transfer body based on a photographed image of the detection pattern, wherein the control unit divides the image photographed by the post-transfer imaging unit into multiple ranges, classifies each of the multiple ranges into a toner portion and a non-toner portion, and quantifies the residual toner of the detection pattern based on a size of the ranges classified as the toner portion.

2. The image forming apparatus according to claim 1, wherein the detection pattern comprises a line image.

3. The image forming apparatus according to claim 2, wherein a width of the line image is equal to or greater than 3 dots.

4. The image forming apparatus according to claim 1, further comprising multiple image forming units arranged side by side, each of the multiple image forming units comprising the latent image carrier and the developing device.

5. The image forming apparatus according to claim 1, wherein the image forming condition is a difference in linear velocity between the latent image carrier and the intermediate transfer body.

6. The image forming apparatus according to claim 1, wherein the image forming condition is a value of a transfer current in the transfer device.

7. An image forming apparatus comprising:

a latent image carrier;

a developing device to supply toner to the latent image carrier and develop a latent image formed on a surface of the latent image carrier with the toner to form a toner image;

a transfer device to either directly transfer the toner image formed on the surface of the latent image carrier onto a recording medium, or to primarily transfer the toner image from the latent image carrier onto an intermediate transfer body and then secondarily transfer the toner image from the intermediate transfer body onto a recording medium;

a post-transfer imaging unit to photograph, at magnification, the surface of the latent image carrier after transfer of the toner image from the latent image carrier onto either the recording medium or the intermediate transfer body, or a surface of the intermediate transfer body after transfer of the toner image from the intermediate transfer body onto the recording medium; and a control unit to control one or more image forming conditions based on a quantified value for residual toner of a detection pattern obtained by forming the detection pattern and photographing a portion of the surface of the latent image carrier or the intermediate transfer body on which the detection pattern is formed after transfer of the detection pattern from the latent image carrier onto the recording medium or the intermediate transfer body or after transfer of the detection pattern from the intermediate transfer body onto the recording medium using the post-transfer imaging unit, the quantified value representing the amount of residual toner of the detection pattern attached to either the surface of the latent image carrier or the intermediate transfer body based on a photographed image of the detection pattern, wherein the control unit divides the image photographed by the post-transfer imaging unit into multiple ranges, classifies each of the multiple ranges into a toner portion and a non-toner portion, performs clustering on the ranges classified as the toner portion, and quantifies the residual toner of the detection pattern based on multiple clusters obtained by performing the clustering.

8. The image forming apparatus according to claim 7, wherein the detection pattern comprises a solid image.

9. The image forming apparatus according to claim 7, wherein the detection pattern comprises a line image.

10. The image forming apparatus according to claim 9, wherein a width of the line image is equal to or greater than 3 dots.

11. The image forming apparatus according to claim 7, further comprising multiple image forming units arranged side by side, each of the multiple image forming units comprising the latent image carrier and the developing device.

12. The image forming apparatus according to claim 7, wherein the image forming condition is a difference in linear velocity between the latent image carrier and the intermediate transfer body.

13. The image forming apparatus according to claim 7, wherein the image forming condition is a value of a transfer current in the transfer device.

14. An image forming apparatus comprising:

a latent image carrier;

a developing device to supply toner to the latent image carrier and develop a latent image formed on a surface of the latent image carrier with the toner to form a toner image;

a transfer device to either directly transfer the toner image formed on the surface of the latent image carrier onto a recording medium, or to primarily transfer the toner image from the latent image carrier onto an intermediate transfer body and then secondarily transfer the toner image from the intermediate transfer body onto a recording medium;

a post-transfer imaging unit to photograph, at magnification, the surface of the latent image carrier after transfer of the toner image from the latent image carrier onto either the recording medium or the intermediate transfer body, or a surface of the intermediate transfer body after transfer of the toner image from the intermediate transfer body onto the recording medium; and a control unit to control one or more image forming conditions based on a quantified value for residual toner of a detection pattern obtained by forming the detection pattern and photographing a portion of the surface of the latent image carrier or the intermediate transfer body on which the detection pattern is formed after transfer of the detection pattern from the latent image carrier onto the recording medium or the intermediate transfer body or after transfer of the detection pattern from the intermediate transfer body onto the recording medium using the post-transfer imaging unit, the quantified value representing the amount of residual toner of the detection pattern attached to either the surface of the latent image carrier or the intermediate transfer body based on a photographed image of the detection pattern, the image forming apparatus further comprising a pre-transfer imaging unit to photograph the toner image formed on the latent image carrier or the intermediate transfer body at magnification, wherein the control unit controls the image forming conditions based on the quantified value for the residual toner and a quantified value for toner of the detection pattern obtained by photographing the detection pattern formed on the latent image carrier or the intermediate transfer body using the pre-transfer imaging unit and quantifying the toner of the detection pattern photographed by the pre-transfer imaging unit before transfer of the detection pattern from the latent image carrier onto the recording medium or the intermediate transfer body or before transfer of the detection pattern from the intermediate transfer body onto the recording medium.

15. The image forming apparatus according to claim 14, wherein the detection pattern comprises a line image.

16. The image forming apparatus according to claim 15, wherein a width of the line image is equal to or greater than 3 dots.

17. The image forming apparatus according to claim 14, further comprising multiple image forming units arranged side by side, each of the multiple image forming units comprising the latent image carrier and the developing device.

18. The image forming apparatus according to claim 14, wherein the image forming condition is a difference in linear velocity between the latent image carrier and the intermediate transfer body.

19. The image forming apparatus according to claim 14, wherein the image forming condition is a value of a transfer current in the transfer device.

20. An image forming apparatus comprising:

a latent image carrier;

a developing device to supply toner to the latent image carrier and develop a latent image formed on a surface of the latent image carrier with the toner to form a toner image;

a transfer device to either directly transfer the toner image formed on the surface of the latent image carrier onto a recording medium, or to primarily transfer the toner image from the latent image carrier onto an intermediate transfer body and then secondarily transfer the toner image from the intermediate transfer body onto a recording medium;

a post-transfer imaging unit to photograph, at magnification, the surface of the latent image carrier after transfer of the toner image from the latent image carrier onto either the recording medium or the intermediate transfer body, or a surface of the intermediate transfer body after transfer of the toner image from the intermediate transfer body onto the recording medium; and a control unit to control one or more image forming conditions based on a quantified value for residual toner of a detection pattern obtained by forming the detection pattern and photographing a portion of the surface of the latent image carrier or the intermediate transfer body on which the detection pattern is formed after transfer of the detection pattern from the latent image carrier onto the recording medium or the intermediate transfer body or after transfer of the detection pattern from the intermediate transfer body onto the recording medium using the post-transfer imaging unit, the quantified value representing the amount of residual toner of the detection pattern attached to either the surface of the latent image carrier or the intermediate transfer body based on a photographed image of the detection pattern, the image forming apparatus further comprising:

a first post-transfer imaging unit to photograph the surface of the latent image carrier after primary transfer of the toner image from the latent image carrier onto the intermediate transfer body; and a second post-transfer imaging unit to photograph the surface of the intermediate transfer body after secondary transfer of the toner image from the intermediate transfer body onto the recording medium, wherein the control unit controls the image forming conditions based on quantified values for primary and secondary residual toner of the detection pattern obtained by photographing the portion of the surface of the latent image carrier on which the detection pattern is formed using the first post-transfer imaging unit after primary transfer of the detection pattern from the latent image carrier onto the intermediate transfer body, photographing the portion of the intermediate transfer body on which the detection pattern is formed using the second post-transfer imaging unit after secondary transfer of the detection pattern from the intermediate transfer body onto the recording medium, the quantified values representing the amount of primary residual toner of the detection pattern photographed by the first post-transfer imaging unit and the amount of secondary residual toner of the detection pattern photographed by the second post-transfer imaging unit.

21. The image forming apparatus according to claim 20, wherein the detection pattern comprises a line image.

22. The image forming apparatus according to claim 21, wherein a width of the line image is equal to or greater than 3 dots.

23. The image forming apparatus according to claim 20, further comprising multiple image forming units arranged side by side, each of the multiple image forming units comprising the latent image carrier and the developing device.

24. The image forming apparatus according to claim 20, wherein the image forming condition is a difference in linear velocity between the latent image carrier and the intermediate transfer body.

25. The image forming apparatus according to claim 20, wherein the image forming condition is a value of a transfer current in the transfer device.

* * * * *